US005584611A

United States Patent [19]

Clonch

[11] Patent Number: 5,584,611

[45] Date of Patent: Dec. 17, 1996

[54] ROOF SUPPORT FOR UNDERGROUND EXCAVATIONS

[75] Inventor: David M. Clonch, Beckley, W. Va.

[73] Assignee: Long-Airdox, Oak Hill, W. Va.

[21] Appl. No.: 344,902

[22] Filed: Nov. 22, 1994

[51] Int. Cl.[6] ..... E21D 15/44

[52] U.S. Cl. ..... 405/299; 175/219; 299/11; 405/291

[58] Field of Search ..... 405/290–302; 175/219; 299/11, 31, 33

[56] References Cited

U.S. PATENT DOCUMENTS

| | | | |
|---|---|---|---|
| 3,320,751 | 5/1967 | Groetschel . | |
| 3,425,229 | 2/1969 | Groetschel . | |
| 3,474,627 | 10/1969 | Groetschel . | |
| 3,505,823 | 4/1970 | Bell . | |
| 3,592,011 | 7/1971 | Brosowski . | |
| 3,626,700 | 12/1971 | Groetschel . | |
| 3,628,335 | 12/1971 | Behr . | |
| 3,631,681 | 1/1972 | Taylor et al. . | |
| 3,748,861 | 7/1973 | Groetschel . | |
| 3,832,856 | 9/1974 | Sigott et al. . | |
| 3,902,325 | 9/1975 | Sigott et al. . | |
| 4,020,640 | 5/1977 | Sigott et al. . | |
| 4,026,118 | 5/1977 | McCay | 405/291 |
| 4,073,151 | 2/1978 | Harmsma . | |
| 4,075,856 | 2/1978 | Sigott et al. . | |
| 4,111,227 | 9/1978 | Sigott et al. | 137/469 |
| 4,143,991 | 3/1979 | Stafford | 405/291 |
| 4,190,385 | 2/1980 | Childress | 175/219 X |
| 4,199,193 | 4/1980 | Damron et al. | 299/31 |
| 4,217,067 | 8/1980 | Lagodka et al. | 405/296 |
| 4,239,289 | 12/1980 | Justice et al. | 299/33 X |
| 4,252,475 | 2/1981 | Cobb et al. | 405/291 |
| 4,299,517 | 11/1981 | Siebenhofer et al. | 405/296 |
| 4,328,994 | 5/1982 | Hakes et al. | 299/11 |
| 4,404,893 | 9/1983 | Sigott et al. | 91/405 |
| 4,571,127 | 2/1986 | Merten et al. | 405/299 |
| 4,595,316 | 6/1986 | Tinnel | 299/33 X |
| 4,613,256 | 9/1986 | Zitz et al. | 405/299 |
| 4,676,697 | 6/1987 | Stafford et al. | 175/219 X |
| 4,747,729 | 5/1988 | Urschitz | 405/296 |
| 4,747,730 | 5/1988 | Urschitz | 405/298 |
| 4,865,390 | 9/1989 | Shrader et al. | 299/11 |
| 4,884,848 | 12/1989 | Wrulich et al. | 299/73 |
| 4,957,327 | 9/1990 | Oppenlander et al. | 299/11 |
| 5,340,199 | 8/1994 | Piefenbrink et al. | 299/10 |

*Primary Examiner*—Dennis L. Taylor
*Attorney, Agent, or Firm*—Keck, Mahin & Cate

[57] ABSTRACT

The present invention is directed to a movable load support used for supporting the roof in underground excavations. The load support includes a primary roof support carried on a base frame and an auxiliary roof support also carried on said base frame but laterally disposed from the primary roof support. The auxiliary roof support is longitudinally and laterally moveable with respect to the primary roof support to successively provide roof support to adjacent areas of the roof.

44 Claims, 21 Drawing Sheets

ROOF SUPPORT FOR UNDERGROUND EXCAVATIONS

FIELD OF THE INVENTION

This invention relates in general to a roof support for use in underground excavation operations such as, coal mining operations, and more particularly to a load support having the capability to move under its own power or from power provided from an external source to be used in pillar extraction methods of underground excavation.

BACKGROUND OF THE INVENTION

The necessity to support the roof and underground cavities during underground excavation is well known in the art. One such example of underground excavation which requires that the roof be supported is commonly referred to as "pillar extraction" and is frequently used in the recovery of underground coal deposits. In such pillar extraction methods, it is desirable to cave the roof under controlled conditions behind the working face.

Generally, during pillar extraction, it is desirable to support the roof in several locations in order to insure the safety of the individuals in the mine and to protect expensive mining equipment from damage as well as to prevent costly delays of the mining operation. There are several methods currently used for supporting the roof during pillar extraction. One such method involves the use of two pairs of conventional mobile roof supports at two specified locations. In particular, one pair is generally positioned in a cross-cut adjacent one end of a mining device such as a continuous miner. The second pair is located in the entry to the pillars to support the roof and generally provide an additional escape path in the event of an emergency. One problem associated with only using two sets of conventional roof supports is that a portion of the roof adjacent the continuous miner is unsupported, leading to a possibly dangerous environment for the workers and the machinery. In order to increase efficiency and decrease travel time of the conventional roof supports a third pair of roof supports may be positioned in another entry. The second and third pair of roof supports alternately move to successive entries to allow the continuous miner to successively extract pillars without interruption as a result of a roof support having to be moved to another entry. Each pair of mobile roof supports generally work together, one supporting the roof while the other is advanced a predetermined distance to support an adjacent area of the roof.

Conventional mobile roof supports are well known in the art and are quite expensive and may cost several hundred thousand dollars each. In addition to the cost of conventional roof supports, operations of the several pairs of roof supports can become complicated as each of the mobile roof support units must be moved independently of the other units which may require, for example, six separate remote control channels. Hand held remote control units are generally limited to four channels thus requiring the use of two hand held units when operating more than two pairs of conventional roof support. Coordinating such movement is difficult and time-consuming and the failure to properly coordinate such movement could potentially prove to be dangerous.

Some prior art devices have attempted to reduce the number of roof supports necessary by coupling essentially identical units together and operating them in tandem. This has however, not reduced the expense nor complexity associated with using mobile roof supports. Moreover, when these coupled units are not in use and need to be transported to other locations in the mine, they are often difficult to maneuver in the narrow confines of the mine environment. Additionally, uncoupling the units to allow transport may result in an exceedingly difficult task that delays the efficient use of the roof supports and other mine equipment.

SUMMARY OF THE INVENTION

It is a general object of the present invention to provide a mobile roof support for underground excavation which overcomes the deficiencies of previously used mobile roof supports. It is a further object of the present invention to provide a mobile roof support which may be transported to a desired roof support location while still maintaining support of an adjacent roof area. Still a further object of the present invention is to provide a mobile roof support which may be easily maneuvered in the narrow and short confines of an underground mine.

In accordance with a preferred embodiment of this invention, a mobile roof support is provided including a base frame and drive means for self propulsion of the roof support. A central roof support braced against the base frame by a plurality of extendable props and a lemniscate linkage assembly is provided. The extendable props are swivelably connected to the underside of the central roof support. In addition, an auxiliary roof support assembly is connected to a carriage which is adapted for longitudinal movement on the base frame. The auxiliary roof support assembly includes an auxiliary roof support frame and an auxiliary roof support braced against the auxiliary roof support frame by at least one extendable prop and a lemniscate mechanism. The auxiliary roof support is positioned adjacent the central roof support and may be extended and retracted laterally between positions adjacent the base frame and distal of the base frame and positions intermediate thereof. The extension and retraction of the auxiliary support frame is provided by a support arm and a hydraulic cylinder attached between the arm and the carriage. Additionally, a pair of cylinders are provided for angularly rotating the support arm and the auxiliary support frame about a horizontal axis adjacent the base frame.

The present invention may be used in underground excavation environments to provide roof support in desired locations. One general method of operating the present invention allows conventional roof supports used in tandem to be replaced by a single device made according to the present invention. This is accomplished in part by the auxiliary roof supports which are movably connected to the base frame of the mobile roof support. As a result, the central roof support may be lowered away from engagement with the roof and the mobile roof support advanced a predetermined distance by the drive means and the central roof support subsequently raised into engagement with the roof while the auxiliary roof supports remain in roof supporting contact with the stratification. Similarly, the auxiliary roof supports may be lowered and moved longitudinally along the carriage to a new roof supporting location while the central roof support remains in roof supporting contact with the stratification. Moreover, the auxiliary roof support assembly is retractable thereby allowing the mobile roof support to be easily maneuvered in the mine.

It is to be understood that both the foregoing general description and the following detailed description are exemplary and are intended to provide further explanation of the invention claimed. The accompanying drawings, which are incorporated and constitute part of the this specification are included to illustrate and provide a further understanding of the apparatus and method of operation of the claimed invention.

BRIEF DESCRIPTION OF THE DRAWINGS

The present invention may be better understood with reference to the detailed description in conjunction with the following figures where like numerals denote identical elements, and in which.

DETAILED DESCRIPTION OF THE PREFERRED EMBODIMENT

Figure 2:
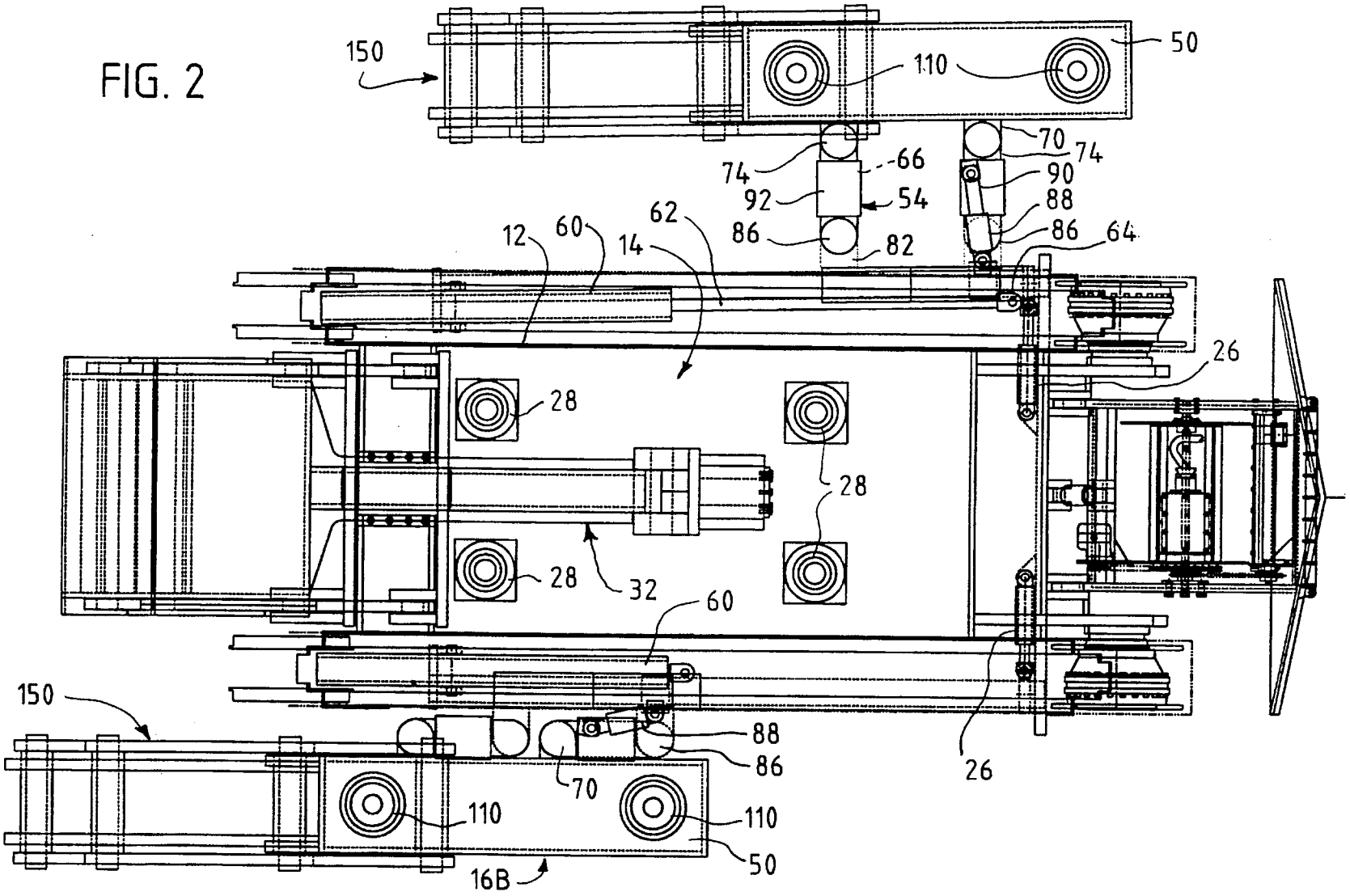
FIG. 2 is a plan view of the mobile pillar extraction roof support made according to the present invention.

Referring to FIG. 2, the mobile pillar extraction roof support is illustrated and shown generally at 10. The mobile pillar extraction roof support (PERS) includes a base frame 12 which carries a primary roof support assembly 14 and also supports a pair of extendable and retractable auxiliary roof support assemblies 16.

Figure 3:
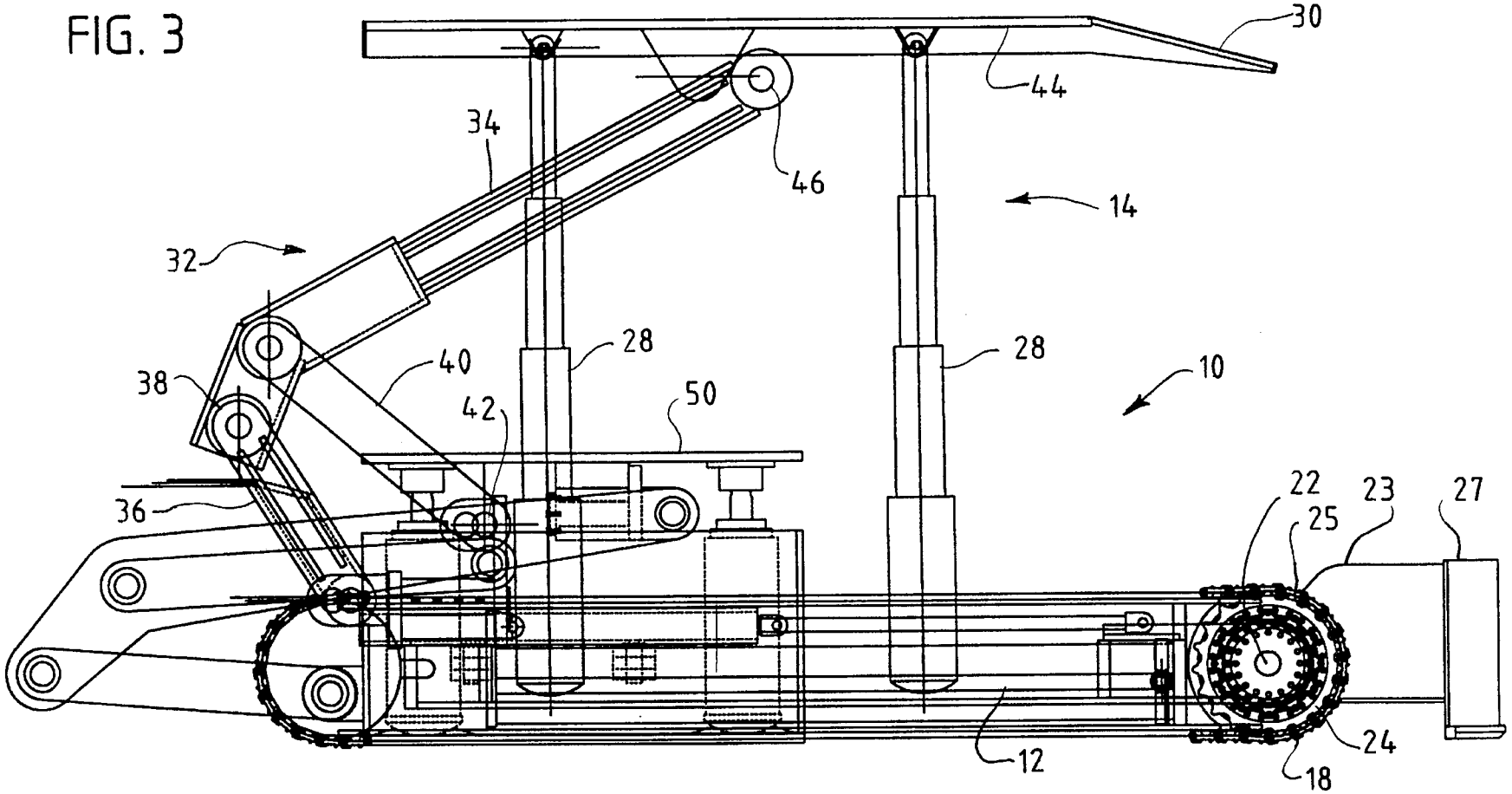
FIG. 3 is a elevational view of the mobile pillar extraction roof support illustrating the central roof support in an extended position.

Referring now to FIG. 3, the base frame 12 is supported and movable on a pair of caterpillar tracks 18 which are driven by a sprocket 24 powered by a hydraulically actuated motor 22 carried on the base frame 12. Power is supplied to the PERS 10 by an electrical cable carried on a cable reel 23 that works in conjunction with a cable reel drive 25 and a spool guide 27. Alternatively, the base frame may be supported on and moved by a series of rollers powered by hydraulic or electric motors. It is preferred that the PERS 10 be self-propelled.

Advancement of the PERS 10 is preferably provided by remote control activation of the caterpillar tracks 18 and associated hydraulic motor 22 by an individual positioned a safe distance from the excavation area so as not to be endangered by roof cave-ins. Such remote control of the PERS may be activated, for example, by radio waves or laser. The remote control also controls the other aspects of the operation of the PERS 10 including but not limited to operation of the roof supports 30 and 50 and the steering cylinders 26. The PERS 10 is also provided with controls (not shown) on the base frame 12 for maneuvering the PERS 10 in emergency situations and when remote control operation is not desirable.

Figure 4:
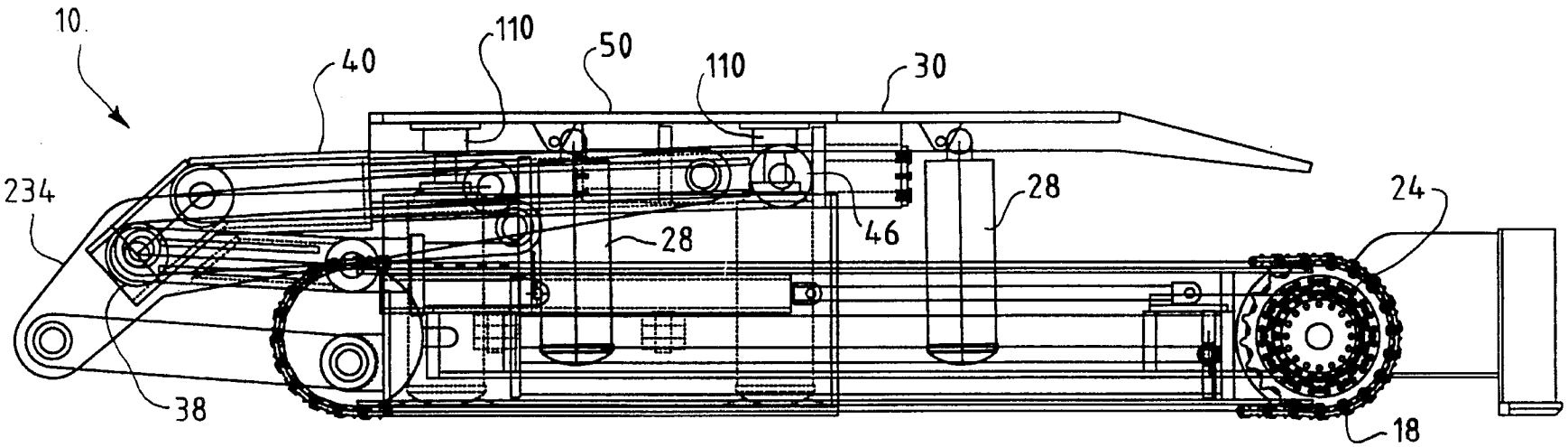
FIG. 4 is a side elevational view of the mobile pillar extraction roof support of FIG. 3 illustrating the central roof support in a retracted position.
Figure 5:
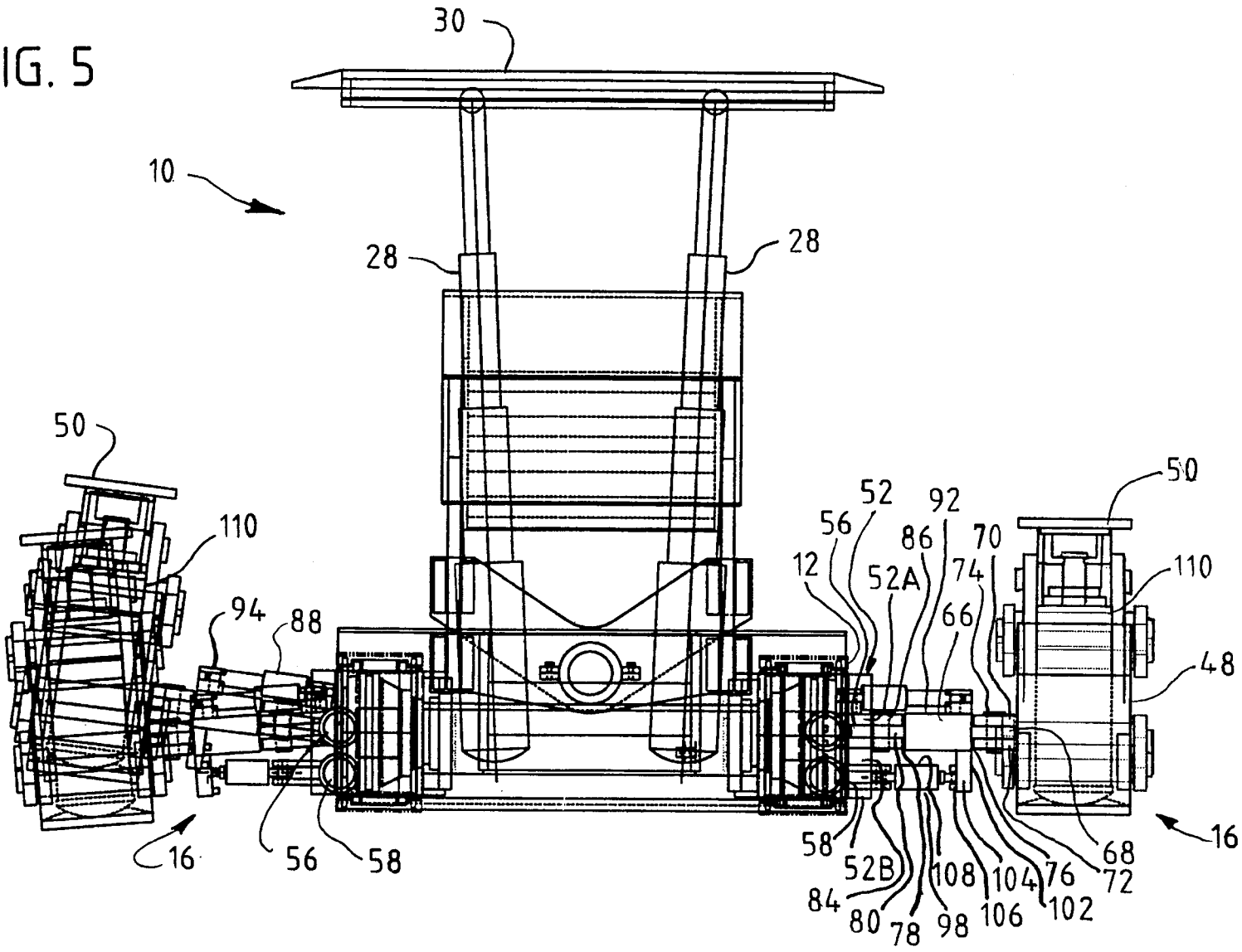
FIG. 5 is a front elevational view of the mobile pillar extraction from roof support made according to the present invention illustrating the central roof support in an extended position.
Figure 21:
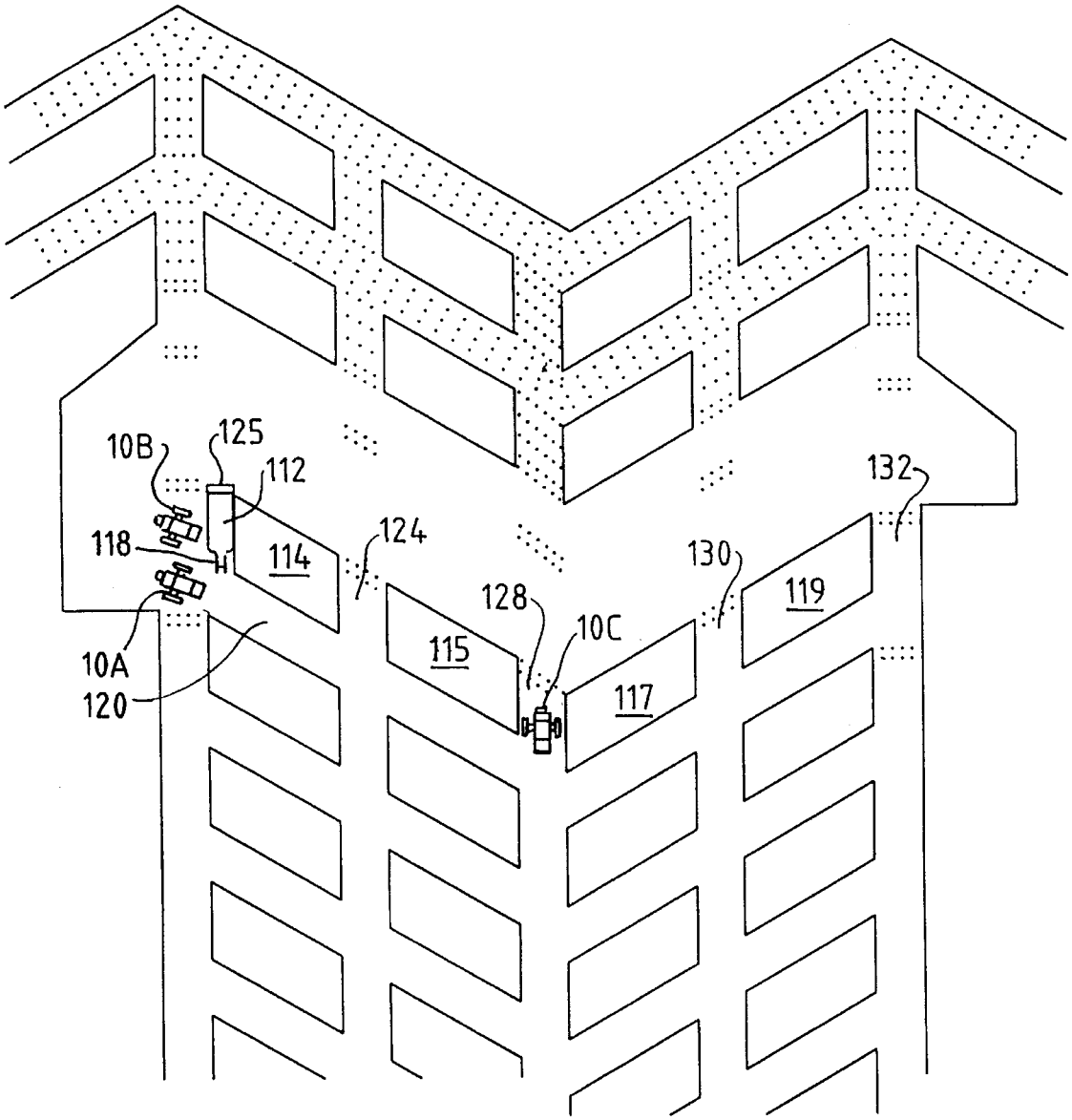
FIG. 21 is a plan view of a first pillar cut in an underground excavation site using pillar extraction roof supports made according to the present invention.

As illustrated in FIGS. 3 and 5, four hydraulically actuated telescoping props 28, each with a number of sections are connected to the corner areas of the base frame 12. It is preferred that the props 28 be swivelably connected to both the base frame 12 and the central roof support 30. Such swivelable attachments may be a ball and socket joint, for example, and should be understood to encompass other attachment devices which allow rotation about the X and Y axis or at least two perpendicular axis. Alternatively, the props 28 may be rigidly connected to both the base frame 12 and the central roof support 30. The props 28 operate in conjunction with a lemniscate mechanism 32 which insures that the central roof support 30 moves in a substantially vertical direction as the props 28 are extended. Alternatively, the central roof support may also be constructed without a lemniscate mechanism or with a single prop 28 working in conjunction with a lemniscate mechanism. The lemniscate mechanism 32 has an upward lemniscate guide 34 and a lower lemniscate guide 36 which are connected at a pivotal joint 38. A directing strut 40 is pivotally linked at one end to the upper lemniscate guide 34. The other end of the directing strut 40 is pivotally connected to a linking point 42 connected to the base frame 12. The upper lemniscate guide 34 is swivelably connected to the underside 44 of the central roof support 30 by means of a swivelable coupling 46. As illustrated in FIGS. 4 and 21, when props 28 are in a retracted position, the PERS 10 maintains a low profile contributing to its ability to be easily maneuvered in the mine.

Props 28 are disposed in an essentially vertical orientation, being inclined only slightly as shown more clearly in FIG. 5. It is preferred, however, to dispose the props 28 in a vertical orientation. The incline of the props may be outwardly as in FIG. 5, or longitudinally. As a result of this vertical orientation of the props 28, if the central roof support 30 is horizontally displaced as a result of rock movement in the roof, this displacement produces only an insignificant change in the vertical distance between the roof support and the base frame and results in only a slight tilting of the roof support. The lemniscate mechanism 32 may also be provided with means which are well known in the art for preventing deformation of the structural components when the roof support is subjected to overload conditions while in the extended position.

The PERS 10 made according to the present invention is also provided with a pair of retractable and angularly adjustable auxiliary roof support assemblies 16 connected on either side of the base frame 12. Each auxiliary roof support assembly 16A and 16B includes a roof support frame 48 which carries an extendable auxiliary roof support 50. The roof support frame 48 is connected by a support arm 54 to a carriage 52 adapted to be moved longitudinally along the edge of the base frame 12.

The support arm 54 is connected to the carriage 52 which rides along guides such as upper shaft 56 and a lower shaft 58 disposed longitudinally along the edge of base frame 12. The carriage 52 is powered by a drive mechanism such as, for example, a hydraulic cylinder 60 mounted parallel to the edge of the base frame 12 and adapted to extend longitudinally thereon as illustrated in FIG. 2. The auxiliary roof support assemblies 16 attached to the carriage 52, may therefore be longitudinally moved along the base frame 12 by actuation of the hydraulic cylinder 60. As shown in FIG. 2, auxiliary roof support assembly 16A is disposed toward the front end of the PERS 10 and the hydraulic cylinder 60 is shown with its rod 64 extended completely. The rod 64 of cylinder 60 is attached to the carriage 52 to provide movement of the carriage 52 along upper and lower shafts 56 and 58. Alternatively, carriage 52 may ride along any guide mechanism including, for example, a single rail or shaft.

Support arm 54 which connects the auxiliary roof support frame 48 to the carriage 52 includes a body 66 having a narrower attachment member 68 extending outwardly therefrom. The attachment member 68 is adapted to be received between two vertically spaced horizontal plates 70 and 72 which are rigidly connected to the auxiliary support frame 48 such as by welding. Alternatively, the horizontal plates 70 and 72 may be integrally cast with the auxiliary support frame 48. A pin 74 is provided that extends successively through the top horizontal plate 70, the attachment member 68 and the bottom horizontal plate 72 to pivotally connect the front end 76 of the support arm 54 to the auxiliary support frame 48. The opposite end 78 of the body 66 of the support arm 54 is similarly connected to the carriage 52 by an attachment member 80 which is positioned between two vertically spaced horizontal plates 82 and 84 extending outwardly from the carriage 52 and secured for rotation about a vertical axis by a pin 86. The outwardly extending horizontal plates 82 and 84 are preferably integrally cast with the carriage 52, but may be rigidly connected to the carriage 52 such as by welding.

Lateral extension and retraction of the auxiliary roof support frame 48 is provided by a hydraulic cylinder 88 pivotally connected at its piston end 90 to the top surface 92 of the carriage 52 and pivotally connected at its rod end 94 to the top surface 96 of the body 66 of the support arm 54. The cylinder 88 is disposed so that when fully extended it will be positioned slightly off from perpendicular from the base frame as shown with respect to auxiliary support assembly 16A in FIG. 2. As a result of this orientation, extension of the cylinder 88 causes the body 66 of support arm 54 to rotate about pins 74 and 86 which causes the body 66 to move from an orientation parallel to the base frame 12 to an orientation perpendicular to the base frame 12. This change in orientation of the body 66 causes the auxiliary roof support frame 48 to be moved from a position adjacent the base frame 12 to a position laterally away from the base frame 12. The body 66 of support arm 54 may be rotated and held in any position between an orientation parallel to the base frame 12 and an orientation perpendicular to the base frame 12. Support arm 54 may also be provided with a stop (not shown), which prevents continued rotation of the auxiliary support frame 48 about pin 74 when the cylinder 88 is in its extended position. As illustrated in FIG. 2, auxiliary support frame is connected (to the carriage 52) by two support arms 54 of identical construction, except that only one cylinder 88 is required on one of the arms 54 to move the auxiliary roof support frame laterally. Additionally, the PERS is provided with a supplemental positioning mechanism in the form of a pair of steering cylinders 26 which when extended and retracted laterally move the upper shaft 56 and lower shaft 58 outwardly and allows the auxiliary roof support assembly to be moved laterally an additional 6 inches when the carriage is moved longitudinally from the rear of the PERS to the front.

Figure 6:
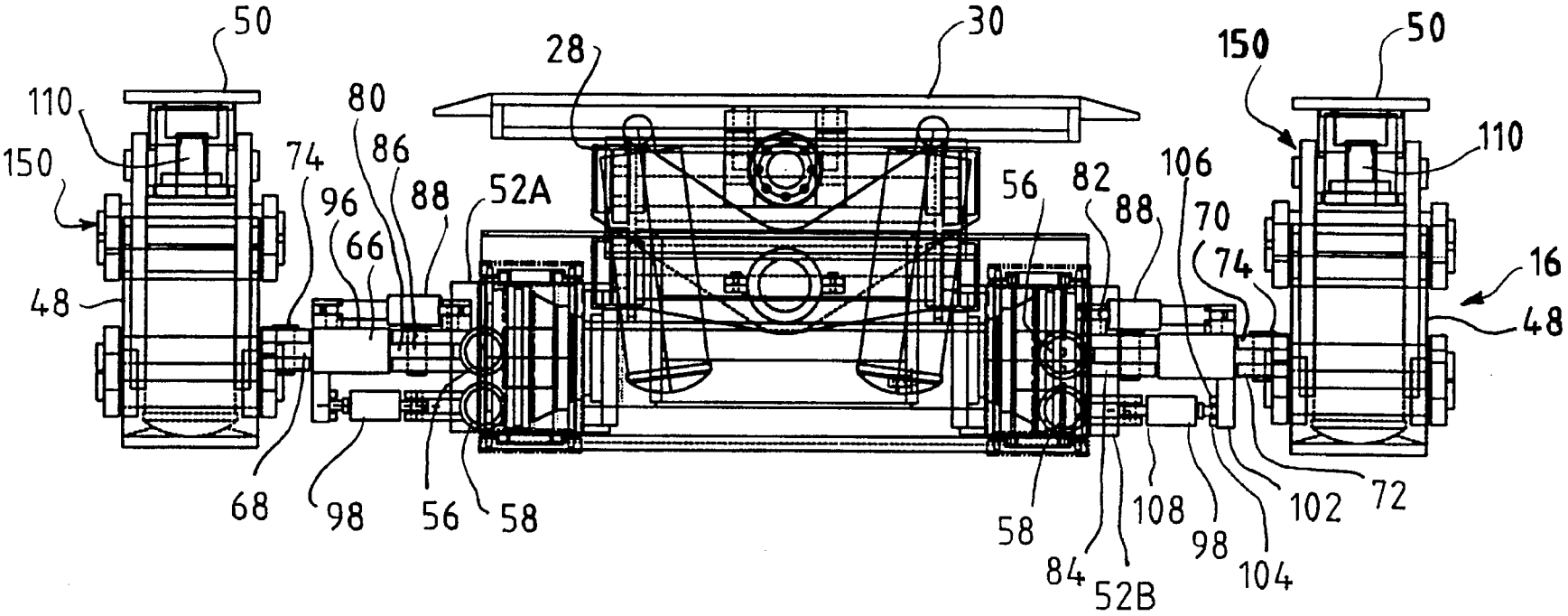
FIG. 6 is a front elevational view of the mobile pillar extraction roof support of FIG. 5 illustrating the central roof support in a retracted position.
Figure 7B:
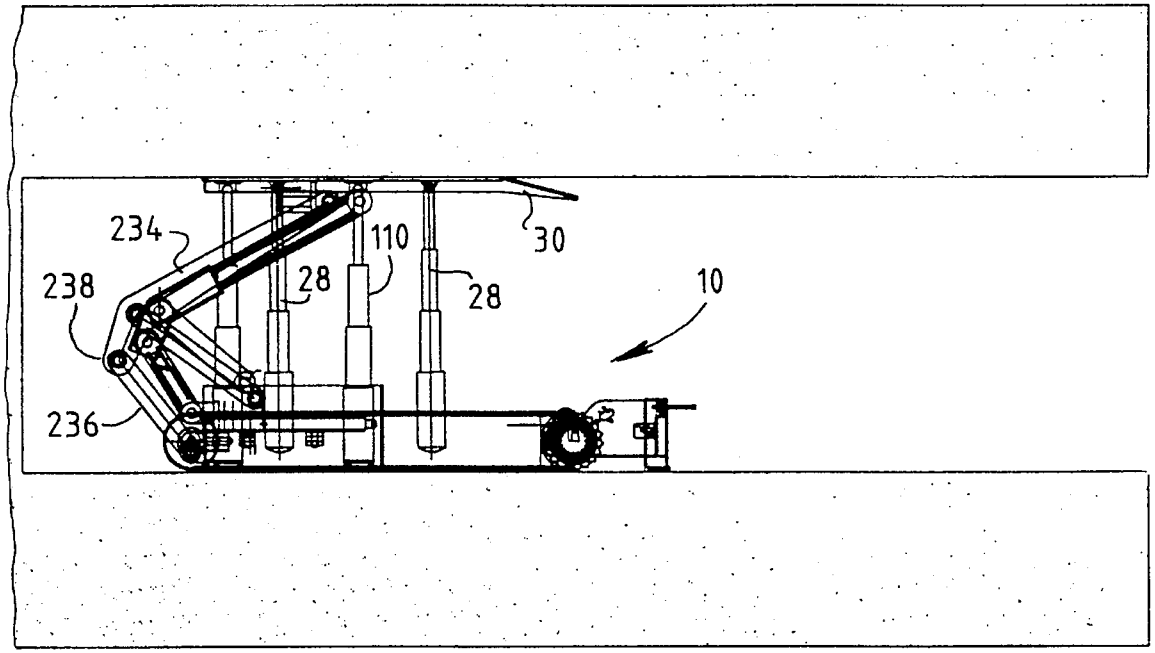
FIG. 7 through 19 are front and side elevational views of the pillar extraction roof support made according to the present invention illustrating serial advancement of the roof support.
Figure 7A:
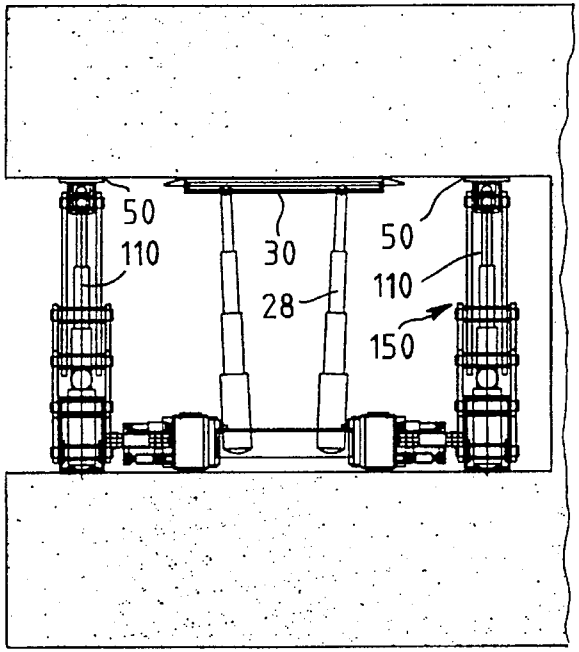
Figure 8B:
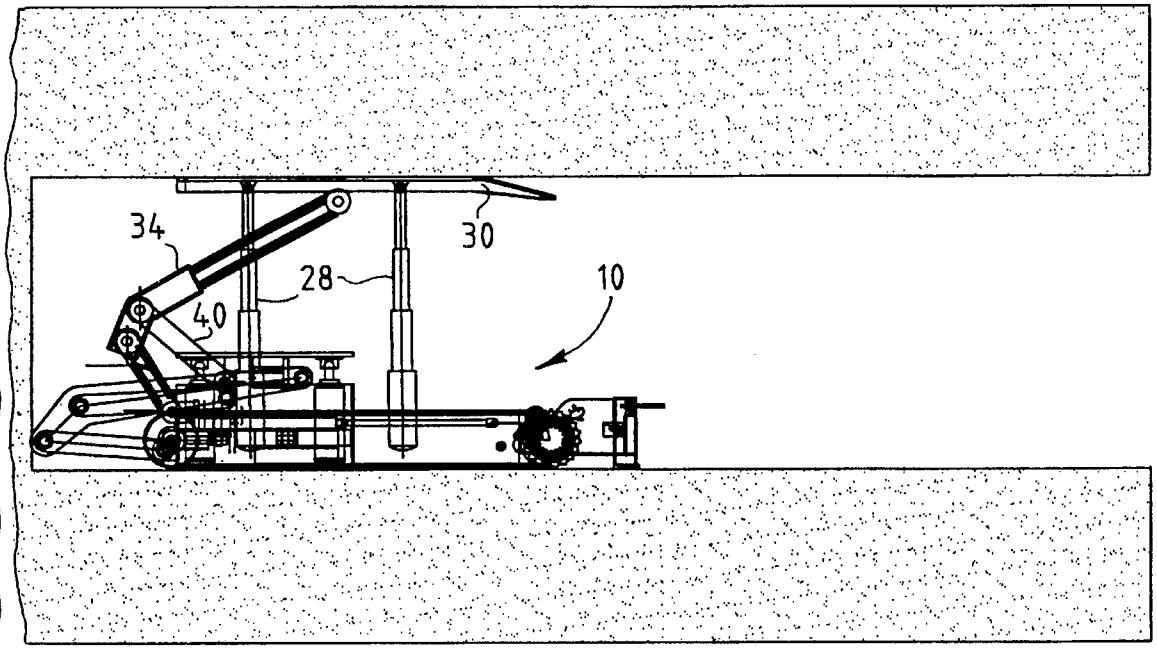
Figure 8A:
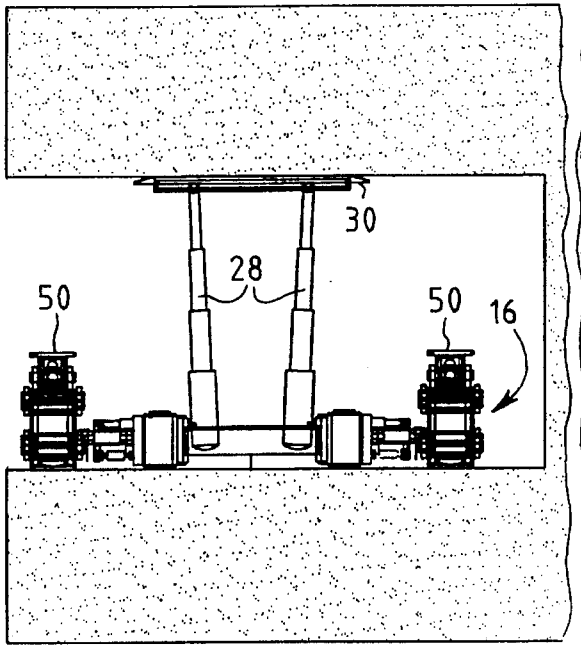
Figure 9B:
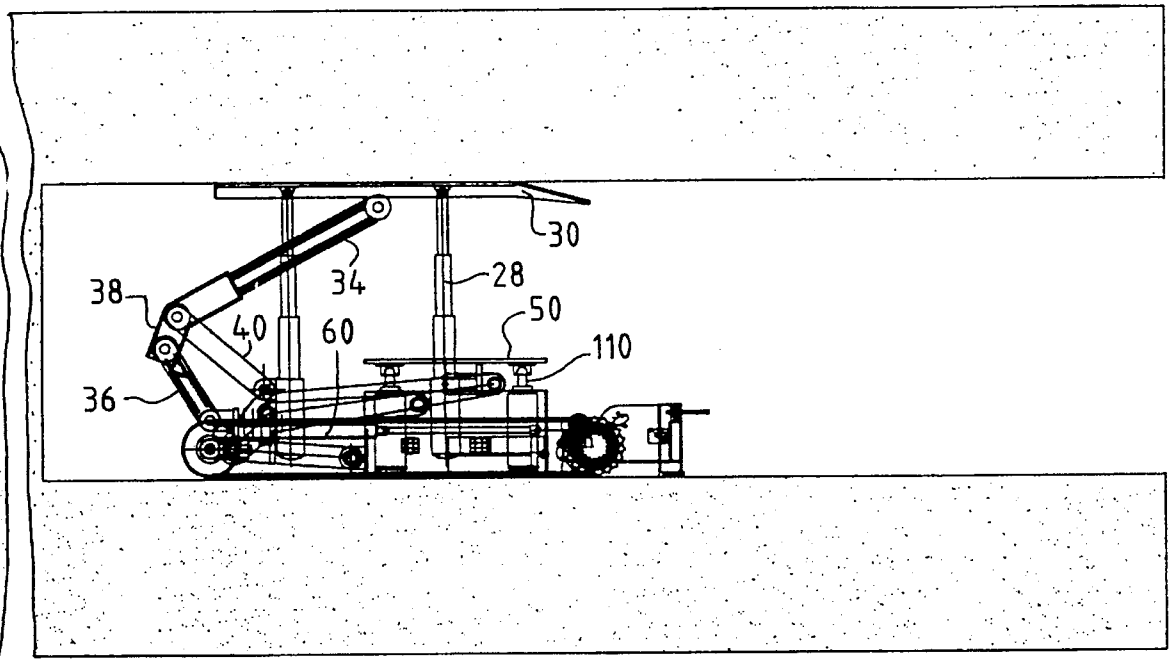
Figure 9A:
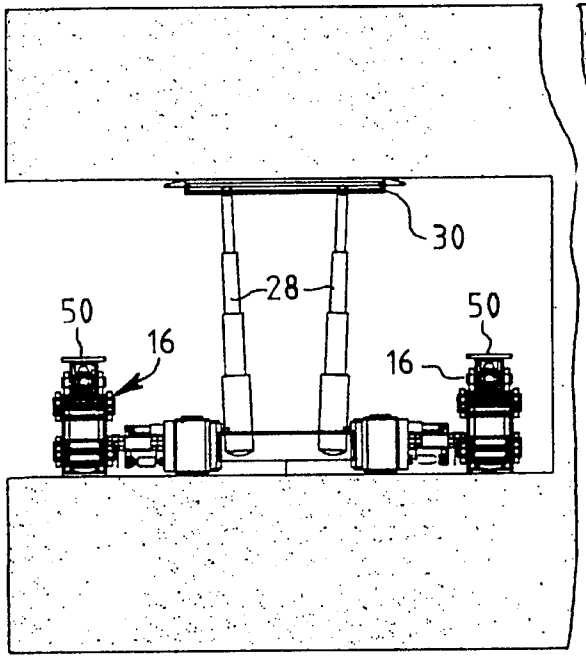
Figure 10B:
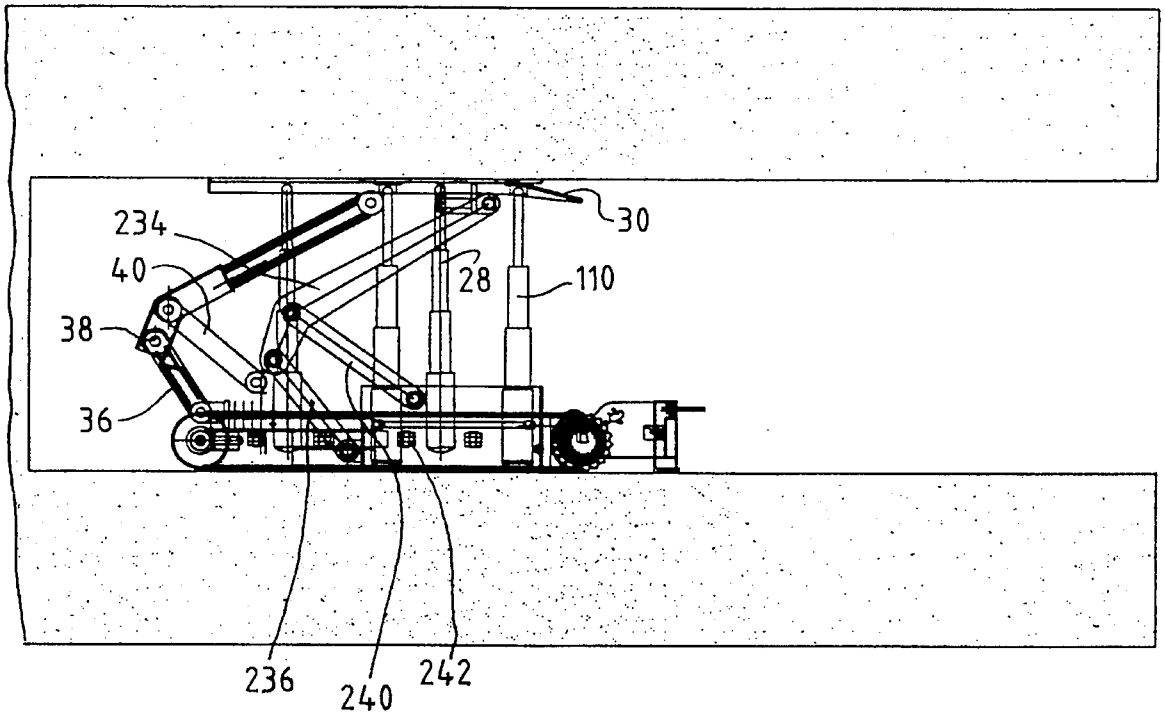
Figure 10A:
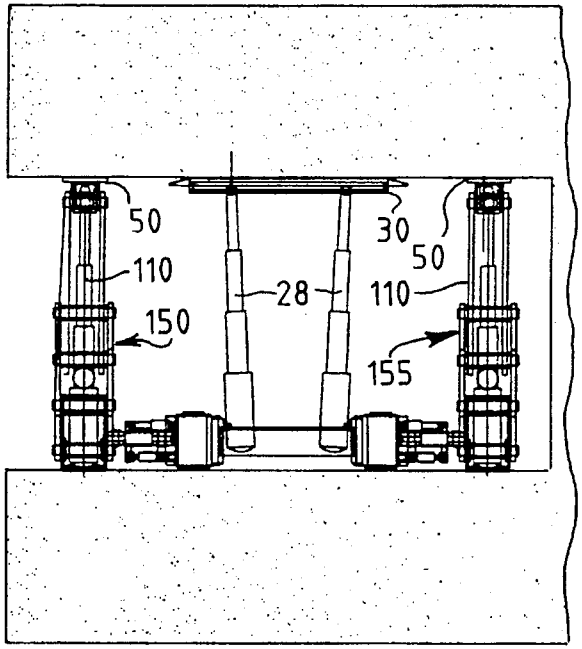

Referring now to FIGS. 5 and 6, an upper portion 52A of the carriage 52 to which the body 66 of support arm 54 is pivotally connected is angularly rotatable about the upper shaft 56 so that the support arm 54 and the auxiliary roof support frame 48 are capable of rotating about the upper shaft 56. The motive force for rotation is provided by a pair of cylinders 98 and 100 swivelably connected to a lower frame section 102 of the body 66 of support arm 54. The operation and arrangement of both of cylinders 98 and 100 is described only with respect to cylinder 98; however, it should be understood that cylinder 100 operates and is arranged in an identical manner. The frame section 102 extends downwardly from the opposite end 76 of the body 66 of support arm 54 and is provided with a coupling 104 which attaches to the rod end 106 of the cylinder 98 which allows for rotation along both a vertical and horizontal axis. The piston end 108 of the cylinder 98 is swivelably connected in a similar manner to a lower portion 52B of the carriage which rides along the lower shaft 58. It should be understood that the lower portion 52B of the carriage 52 to which the cylinder 98 is connected does not rotate about lower shaft 58. Extension and retraction of the lower cylinders 98 and 100 angularly rotates the support arm 54 and the auxiliary roof support frame 48 about upper shaft 56. The arm 54 and auxiliary roof support frame 48 may be angularly rotated about the upper shaft 56 regardless of the extent to which the auxiliary roof support frame 48 has been extended or retracted laterally from the base frame 12.

A portion of the auxiliary roof support assembly 16 includes the roof support frame 48, the auxiliary roof support 50 and two hydraulically telescoping props 110 each with a number of sections. It is preferred that the props 110 be swivelably connected to both the auxiliary roof support frame 48 and the auxiliary roof support 50. The props 110, may alternatively be rigidly connected to the support frame 48. The props 110 are disposed in an essentially vertically orientation. The props 110 preferably operate in conjunction with a lemniscate mechanism 150 as shown in FIGS. 7 through 19 which insures that the auxiliary roof support 50 moves in a direction substantially perpendicular to the roof support frame 48 as the props are extended and provides additional stability. The lemniscate mechanism 150 is constructed similarly to lemniscate mechanism 32 and includes an upper lemniscate guide 234, and a lower lemniscate guide 236 which are connected at a pivotal joint 238. A directing strut 240 is pivotally linked at one end to the upper lemniscate guide 234. The other end of the directing strut 240 is connected to a linking point 242 connected to the support frame 48. Alternatively, the auxiliary roof support assembly 16 may be operated without a lemniscate guide as illustrated in FIG. 4.

Thus, the PERS 10 of the present invention provides a single mobile pillar extraction roof support unit which is capable of supporting a significantly greater area of roof than conventional roof support units and also provides increased maneuverability due to the retractability of the auxiliary roof support assemblies 16.

Figure 11B:
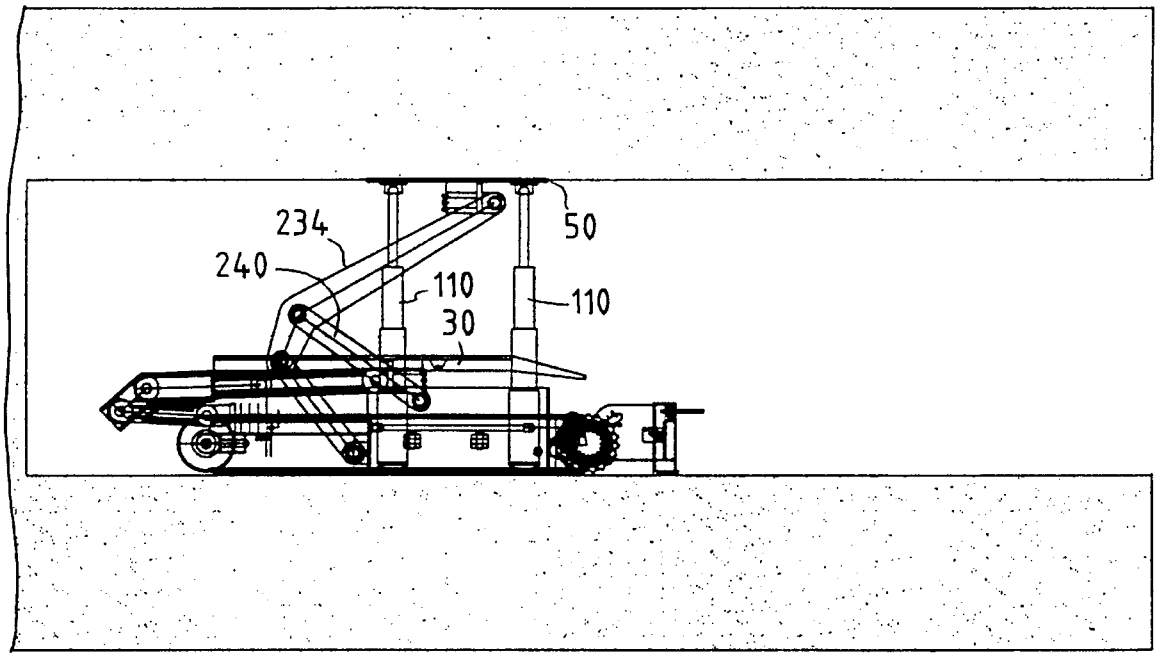
Figure 11A:
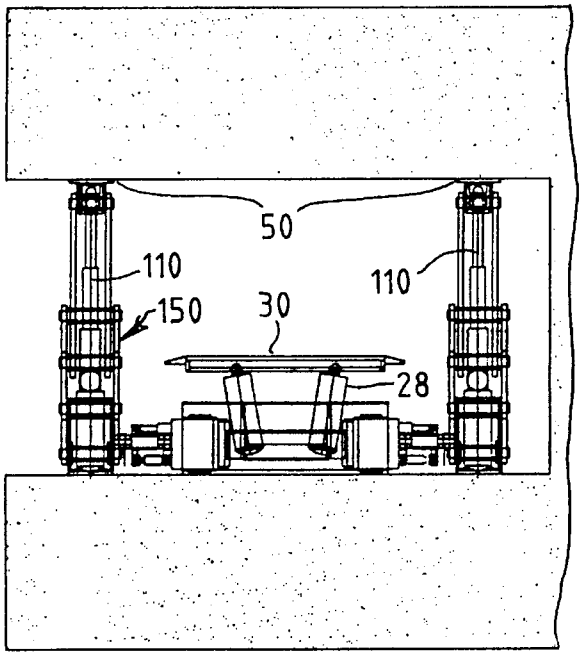
Figure 12B:
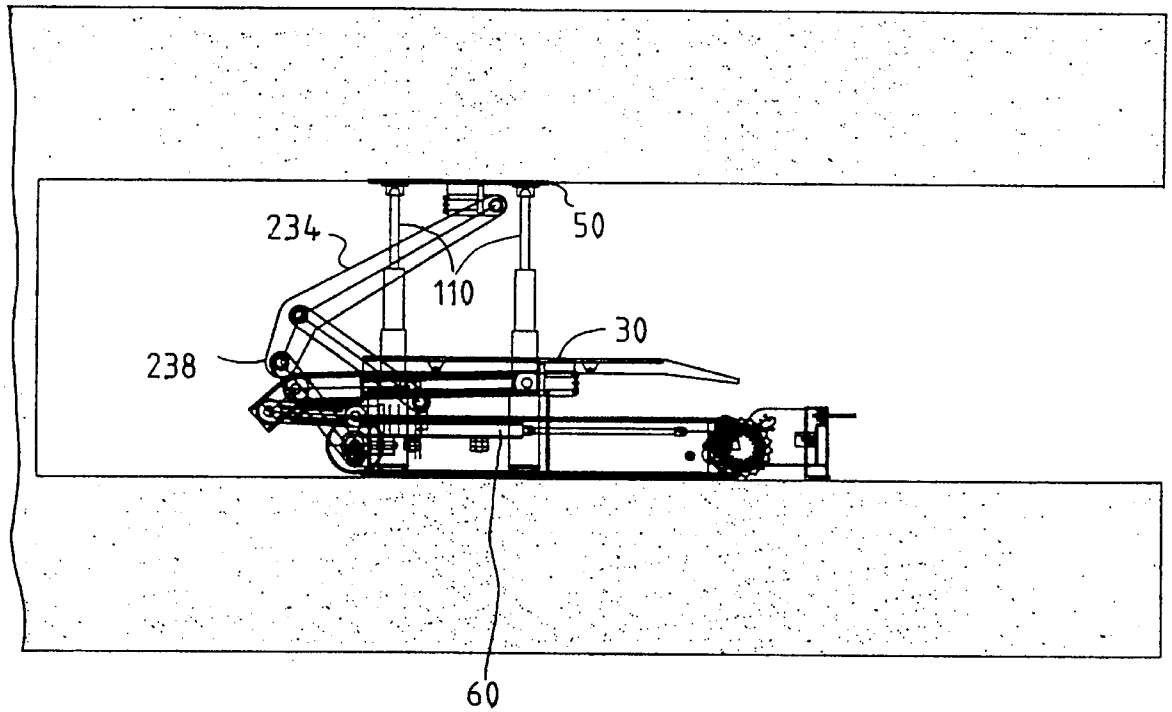
Figure 12A:
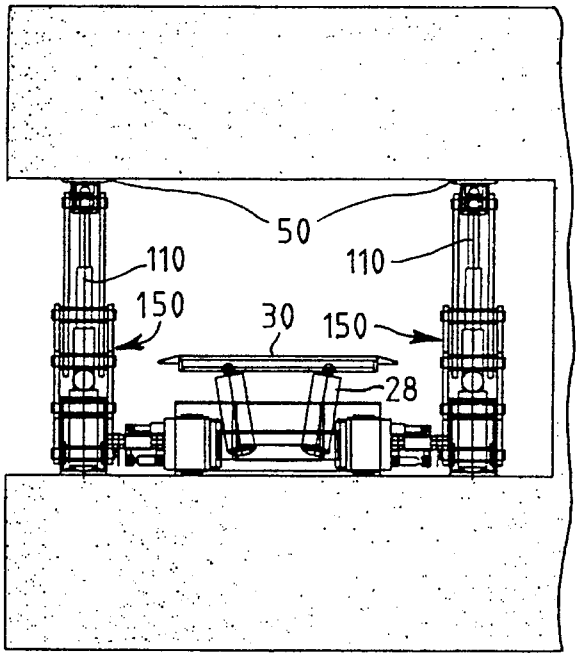
Figure 13B:
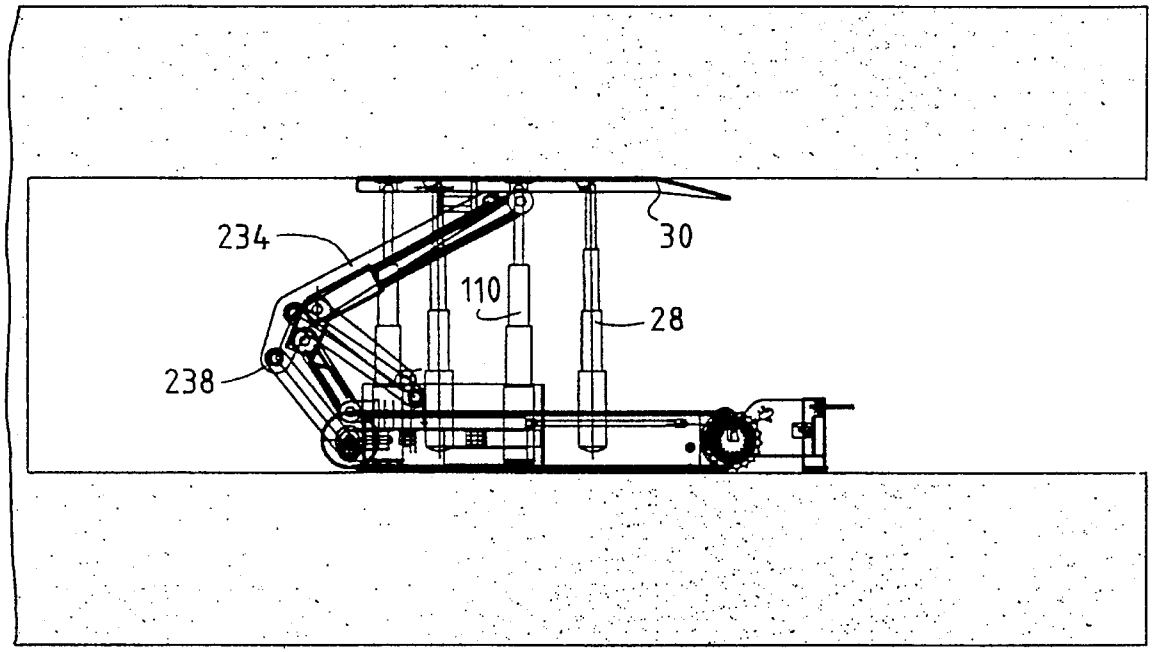
Figure 13A:
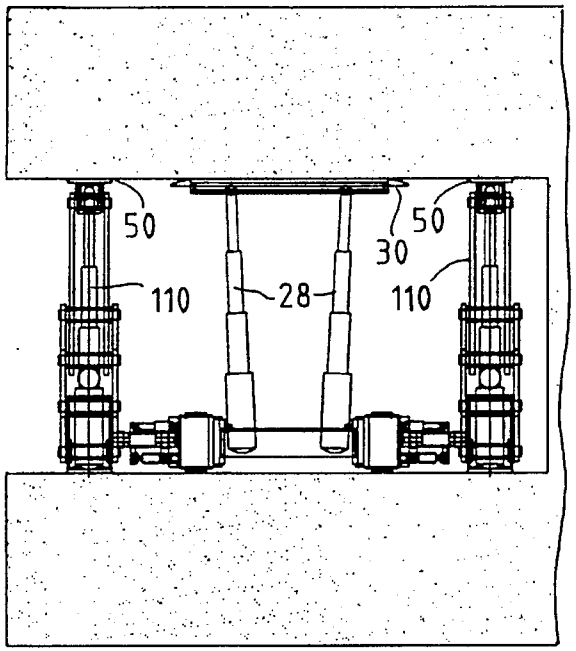
Figure 14B:
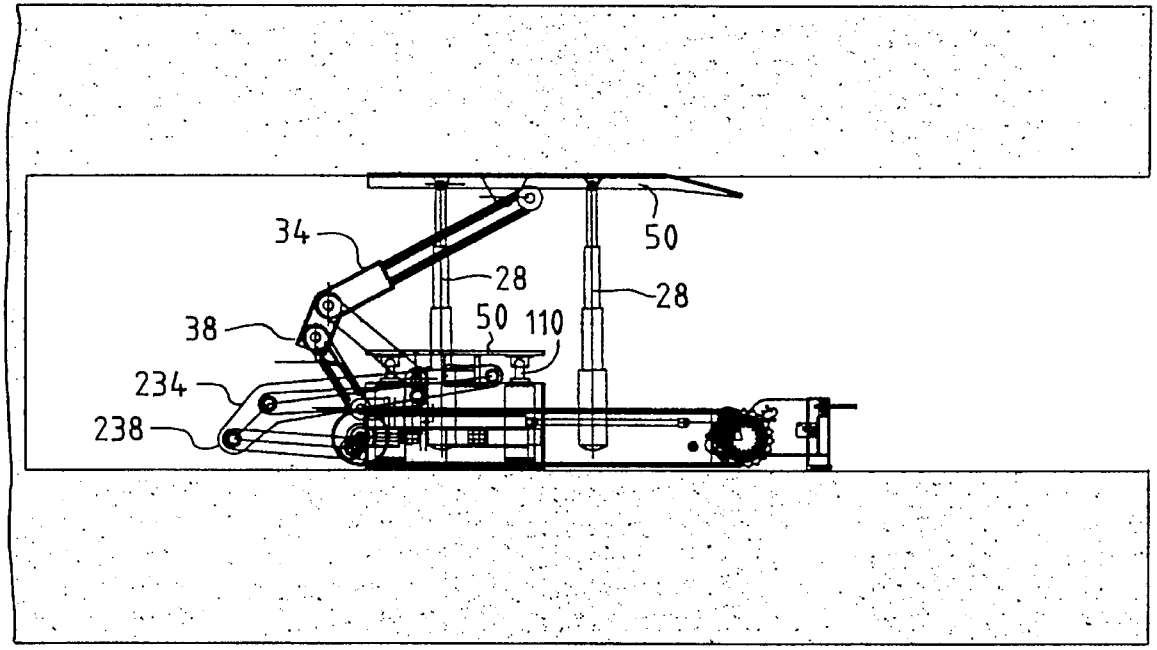
Figure 14A:
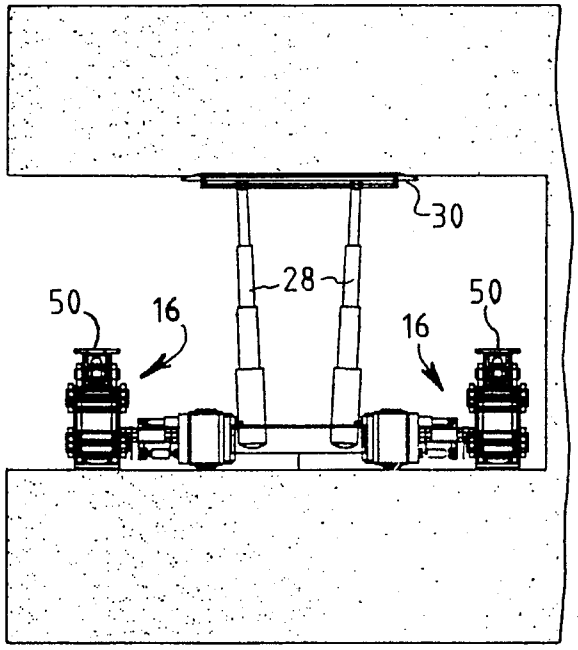
Figure 15B:
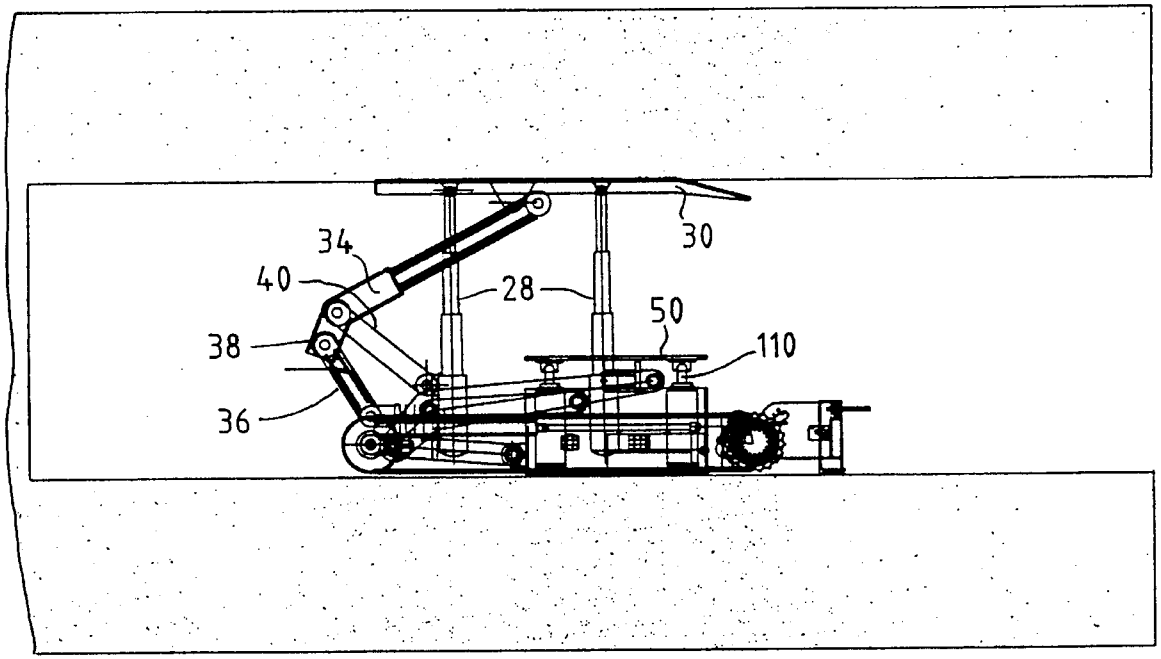
Figure 15A:
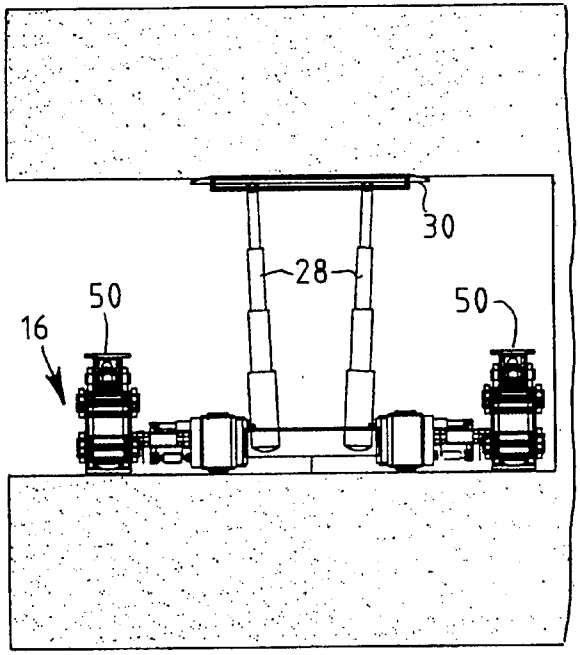
Figure 16B:
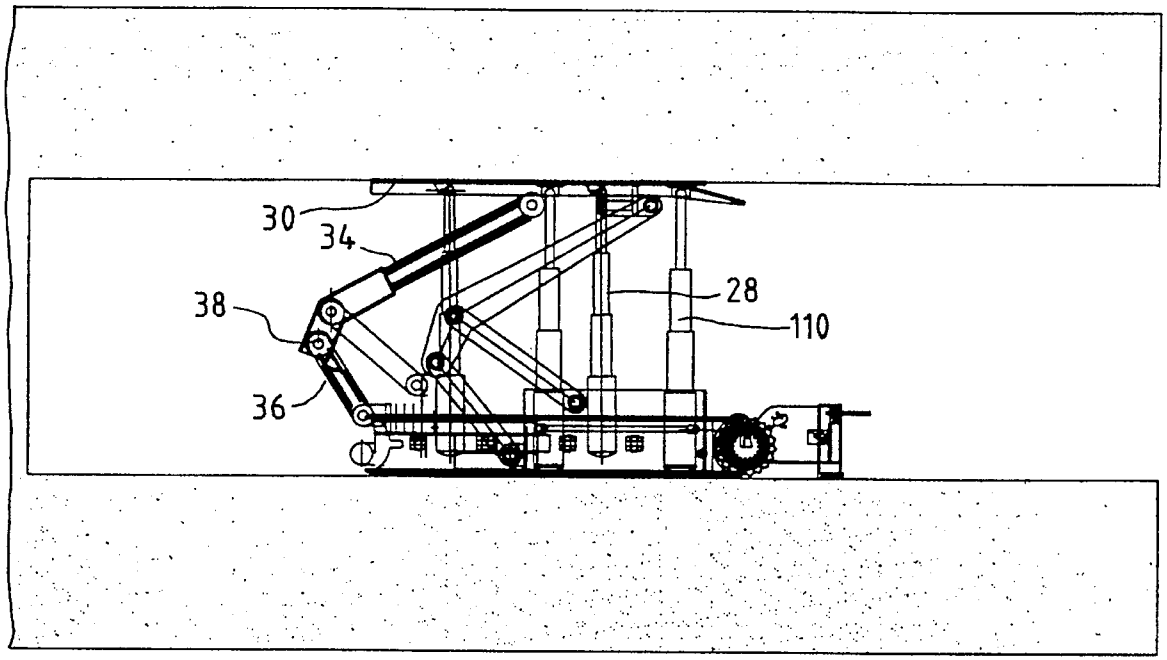
Figure 16A:
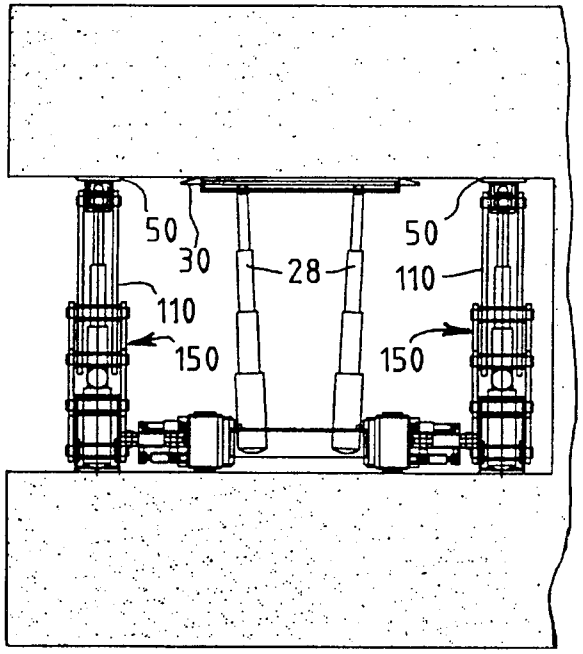
Figure 17B:
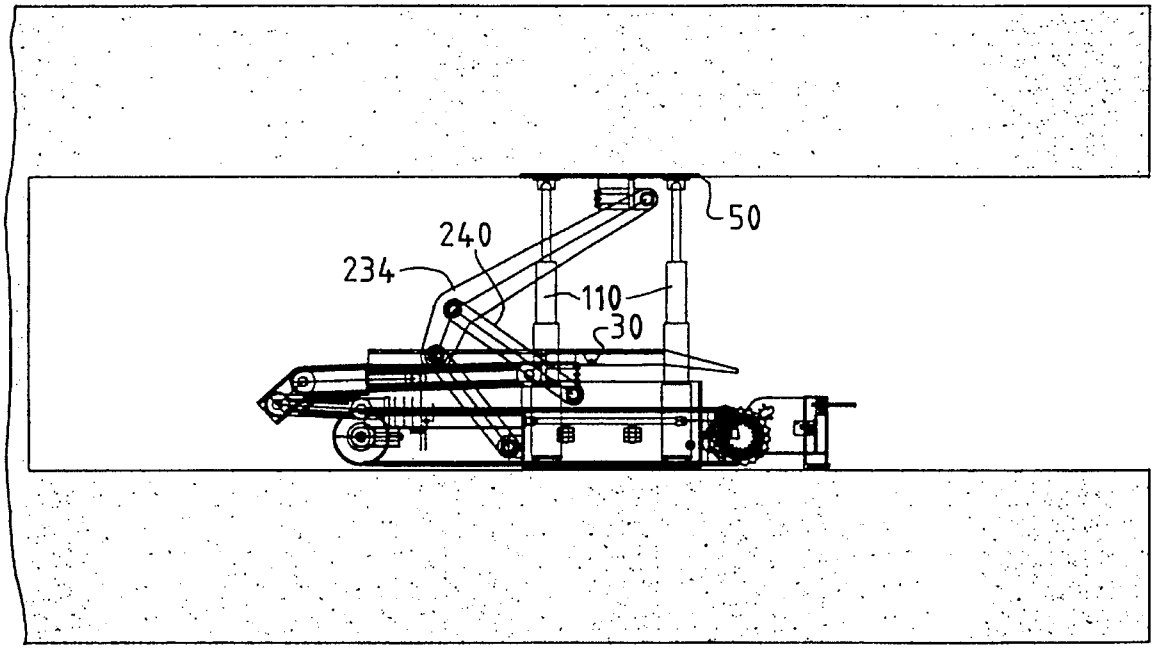
Figure 17A:
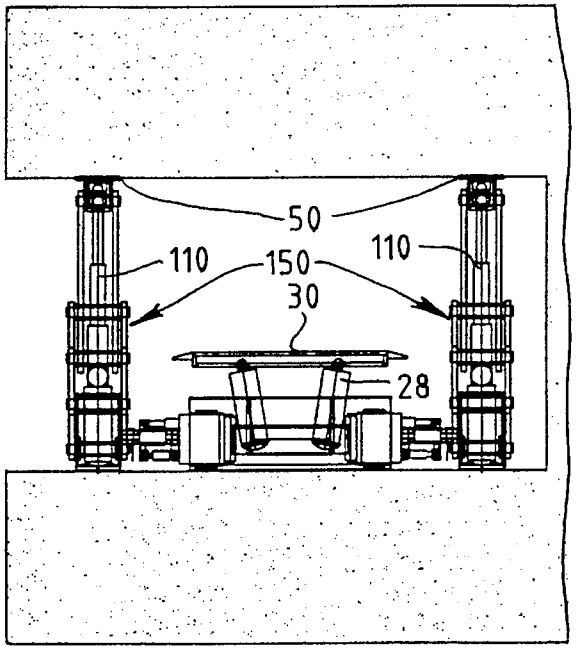
Figure 18B:
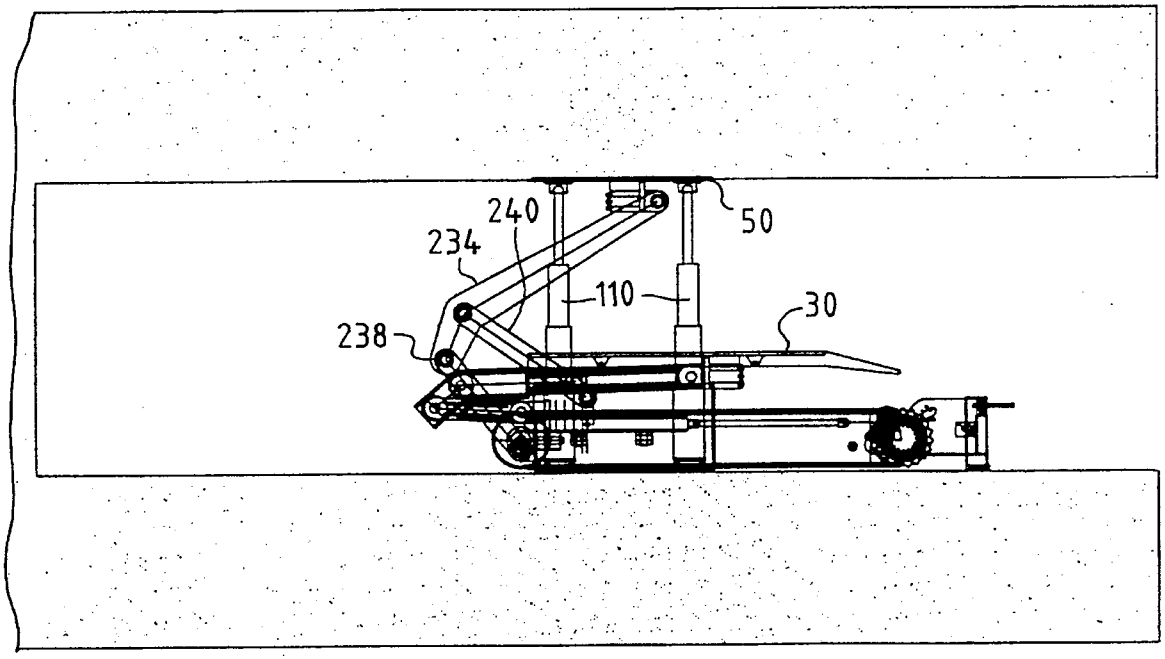
Figure 18A:
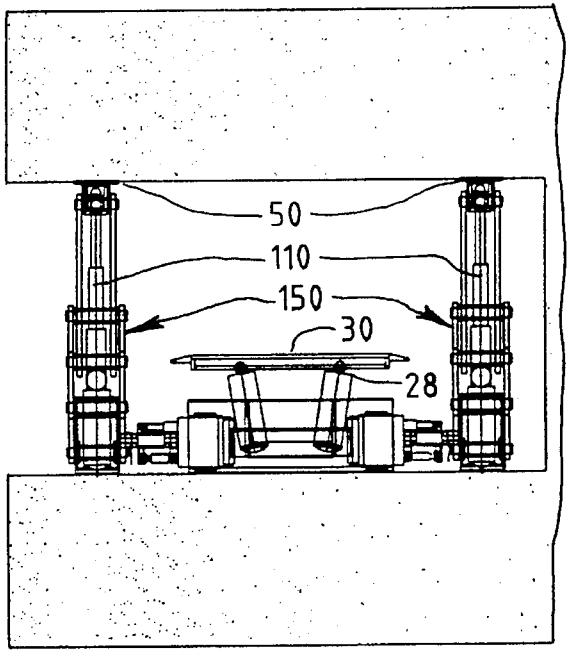
Figure 19B:
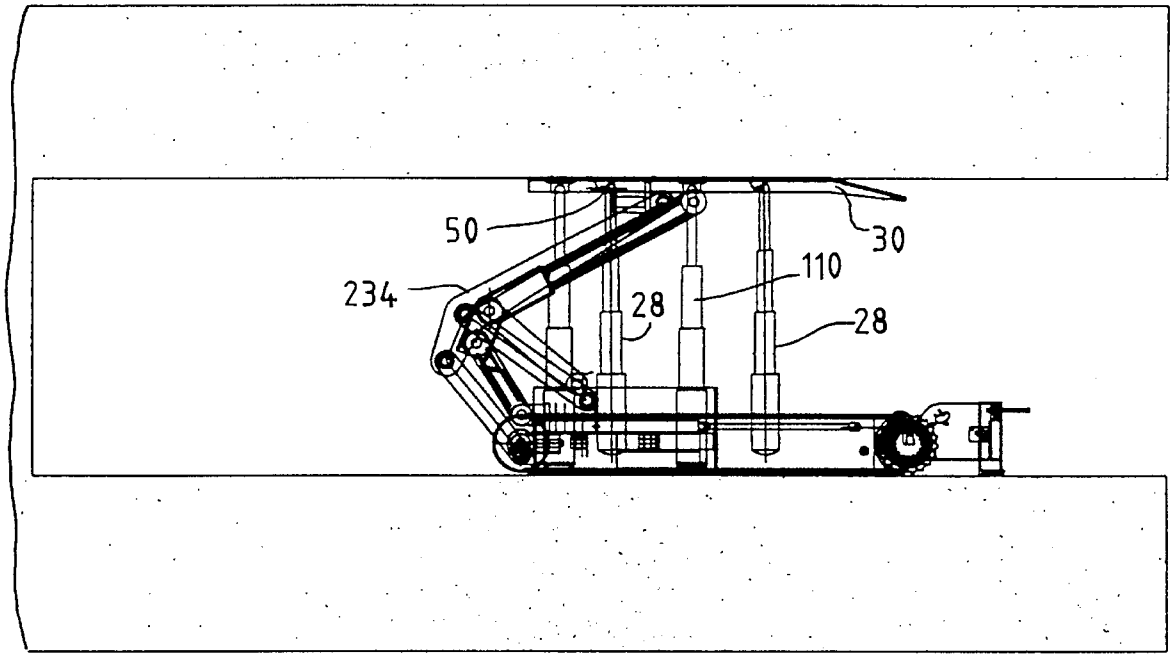
Figure 19A:
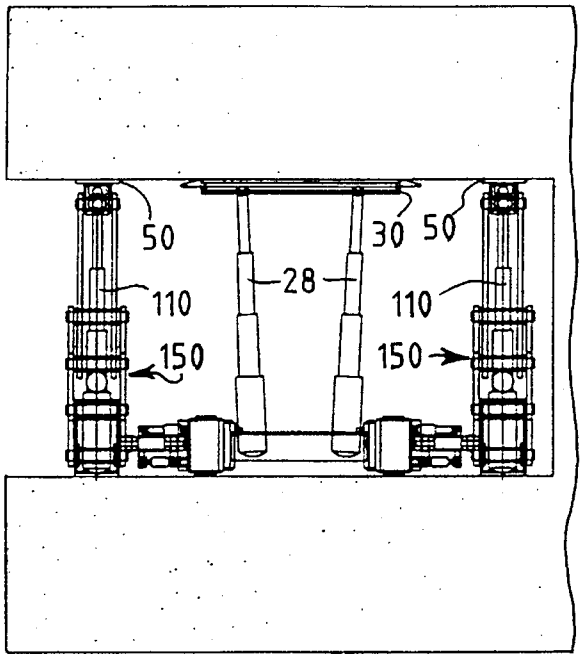

By way of example, the PERS 10 of the present invention may be operated in the following manner to successively support a large area of roof during underground excavations as illustrated in FIGS. 7 through 19. Initially, the PERS 10 is moved to a desired position for roof support, preferably by remote control of its drive mechanism. The auxiliary roof support assemblies 16 are positioned toward the rear end of the base frame 12 by retraction of the cylinders 60. The central roof support 30 is extended by actuation of the four props 28 and the lemniscate mechanism 32 and contacts the stratification thereby providing support. The auxiliary roof support frames 48 are extended by actuation of cylinders 88 and auxiliary roof supports 50 are also contacted with a portion of the stratification by extension of props 110 associated with each assembly 16. In order to move forward to a new area where roof support is desired, the auxiliary roof supports 50 are lowered by retraction of props 110 and advanced forward by actuation of cylinders 60. During forward movement of the auxiliary roof support assemblies 16, the central roof support 30 continues to support the roof. When the carriages 52 are moved to their forwardmost position on upper and lower shafts 56 and 58, auxiliary roof supports 50 may be extended by props 110 to engage the roof above. The central roof support 30 is then lowered and the PERS 10 is moved forward by actuation of its caterpillar tracks 18 a predetermined distance. The predetermined distance for advancement to support adjacent roof areas is limited to approximately five feet due to the dimensions of the device. However, during advancement of the PERS 10 as illustrated in FIGS. 11 and 12, carriages 52 are moved relative to the base frame 12. The cylinders 60 which control movement of the carriage 52 are retracted during movement of the PERS 10 to maintain the auxiliary roof support assemblies 16 in their roof contacting position. The ability to coordinate the advancement of the PERS 10 with the retraction of cylinders 60 is well known in the art and may be accomplished by bleeding the hydraulic fluid of cylinders 60 to a reservoir. Once the PERS 10 has moved forward, the central roof support 30 is extended and engages the stratification thereabove. Because advancement is limited to five feet intervals, the area of the roof that the central roof support 30 will engage will generally include approximately fifty percent new roof area and fifty percent previously engaged roof area. Auxiliary roof supports 50 may then be lowered and moved forward by actuation of cylinders 60 which moves carriages 52 forward along upper and lower shafts 56 and 58. When the carriages 52 are moved to their forwardmost position on upper and lower shafts 56 and 58 auxiliary roof supports 50 may be extended by props 110 to again engage the roof above. The central roof support may be lowered and the PERS advanced as before and the central roof support raised to engage the roof, completing the cycle. The auxiliary roof supports 50, after advancement of the PERS 10 and the carriages 52 will generally not engage stratification that was previously engaged when the auxiliary roof supports were in their initial positions.

During pillar extraction, roof supports are generally moved in ten foot intervals corresponding to the ten foot sections of the pillar removed by a continuous miner. Therefore the PERS 10 would have to be moved two times each time a continuous miner or other mining mechanism is advanced through the pillar.

Figure 1:
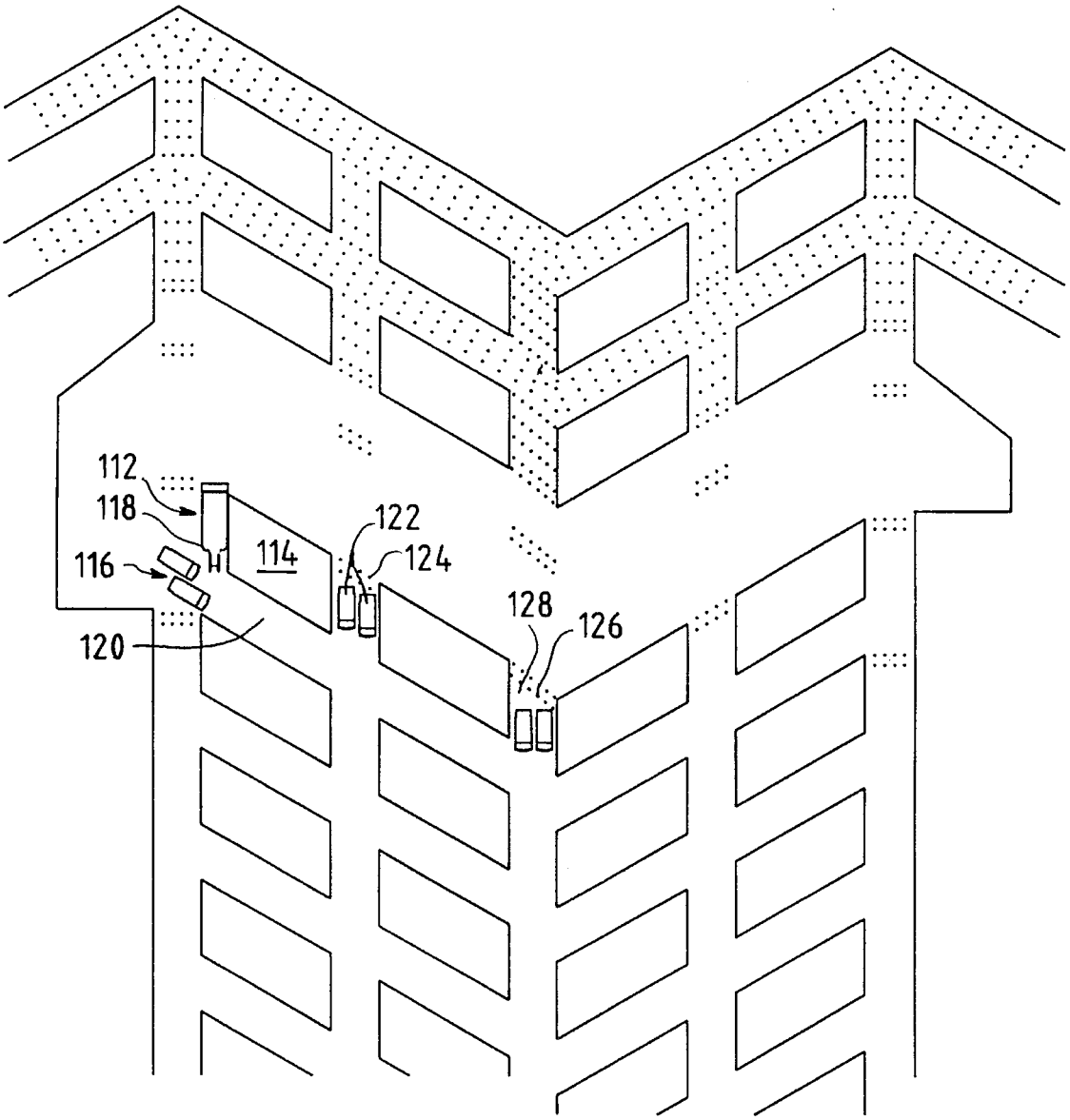
FIG. 1 is a plan view of a first pillar cut in an underground excavation site using conventional mobile roof support apparatus.

As an example of the environment in which the present invention would be useful, reference is now made to FIG. 1, which illustrates in plan view a typical operation involving pillar extraction from a coal mine. As illustrated, a continuous miner 112 is completing its first cut along a first pillar 114. A pair of conventional mobile roof supports 116 working in tandem are located adjacent the rearward end 118 of the continuous miner and a cross-cut 120. An additional pair of conventional mobile roof supports 122 are located in entry 124. A final pair of conventional mobile roof supports 126 are located in entry 128 which may be used as an escape route. Therefore, the pairs 122 and 126 may be moved alternately in a leap-frog fashion to successive entry ways to allow for efficient extraction of the remaining pillars. However, a portion of the continuous miner remains unprotected.

Figure 20:
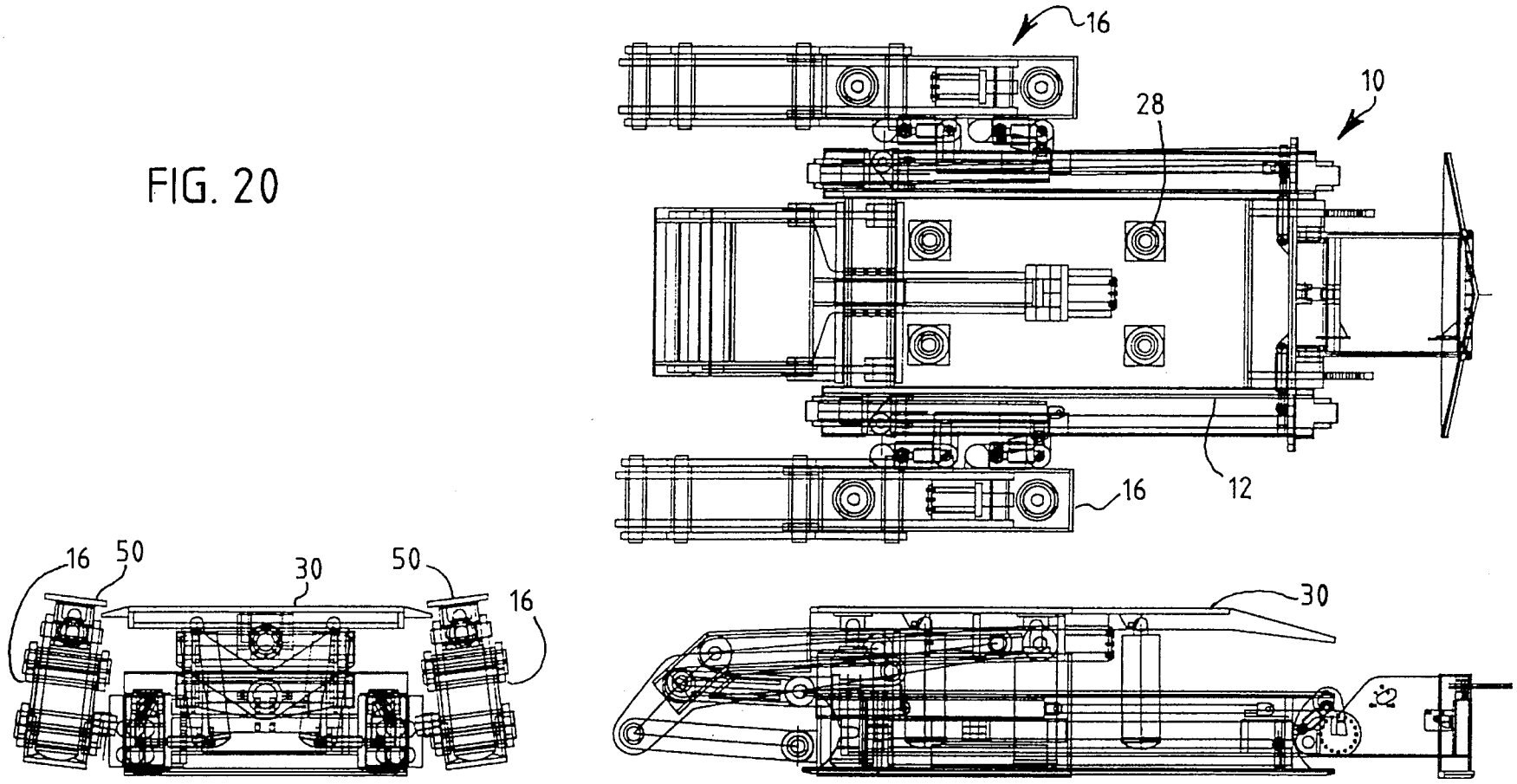
FIG. 20(*a*) through (*c*) is a front elevational, side elevational and plan view of the pillar extraction roof support made according to the present invention illustrating the orientation of the roof support while it is being transported.

Turning to FIG. 21, the present invention reduces in half the required number of roof support units to be utilized. As illustrated, one PERS 10A made according to the present invention is located adjacent the continuous miner 112 and cross-cut 120. A second PERS 10B made according to the present invention is located adjacent the forward end 125 of the continuous miner 112. A third PERS 10C made according to the present invention is located in the entry 128. As the continuous miner 112 extracts coal from the first pillar 114, the PERS 10A and 10B may be advanced as described above to provide continued protection to the continuous miner 112. PERS 10C remains stationary protecting the entry 128. When the continuous miner 112 is completed with extraction of the left side pillars 114 and 115, the auxiliary roof support assemblies 16 of the PERS 10A and 10B may be lowered and retracted as shown in FIG. 20 and the PERS 10A and 10B moved quickly to the far right entry 132 where roof support protection is desired. The continuous miner 112 is also moved to the far right in FIG. 21 to begin removal of pillars 119 and 117. PERS 10A and 10B continue to provide roof support for the continuous miner 112 and advance with the continuous miner 112 as described above.

While one embodiment of the mobile pillar extraction roof support of this invention has been shown in accordance with the invention, as well as methods of operation, it should be apparent to those skilled in the art that what has been described is considered at the present to be a preferred embodiment of the pillar extraction roof support and the methods of operation in accordance with this invention. In accordance with the patent statutes, changes may be made in the PERS and its operation in accordance with this invention without actually departing from the true spirit and scope of this invention. The following claims are intended to cover all such changes and modifications which fall in the true spirit and scope of this invention.

What is claimed is:

1. A movable load support comprising:

a base frame;

drive means communicating with said base frame for advancing said base frame;

a central roof support braced against said base frame by a plurality of extendable props;

at least one auxiliary roof support assembly coupled to said base frame by at least one extendable support assembly disposed on a carriage mounted for longitudinal movement on said base frame and disposed adjacent said base frame and laterally from said central roof support, said auxiliary roof support assembly including an auxiliary roof support braced against an auxiliary roof support frame by at least one extendable prop swivelably connected to said auxiliary roof support, whereby said auxiliary roof support frame is selectably positionable between a first position adjacent said base frame and a second position distal from said base frame and positions intermediate said first and second positions.

2. The movable load support of claim 1 further including a lemniscate mechanism connected between said base frame and central roof support that operates in conjunction with said plurality of extendable props.

3. The movable load support of claim 1 further including a second lemniscate mechanism connected between said auxiliary roof support frame and said auxiliary roof support that operates in conjunction with said at least one extendable prop.

4. The movable load support of claim 1, wherein said plurality of extendable props are disposed slightly outwardly from a perpendicular orientation with respect to said base frame.

5. The movable load support of claim 1, wherein said carriage is connected to said base frame and adapted for longitudinal movement along a guide member disposed along the edge of said base frame.

6. The movable load support of claim 5, wherein said auxiliary roof support frame is connected to said carriage by a support arm, said support arm having a body pivotally connected at one end to said auxiliary support frame about a vertical axis and pivotally connected at the opposite end to said carriage about a vertical axis.

7. The movable load support of claim 6, further including a hydraulic cylinder connected between said carriage and said body of said support arm for laterally moving said auxiliary roof support frame between a first position adjacent said base frame and a second position distal therefrom and positions intermediate said first and second positions.

8. The movable load support of claim 1, wherein said auxiliary roof support frame is angularly rotatable with respect to said base frame.

9. The movable load support of claim 6 wherein said carriage includes an upper portion and a lower portion, said upper portion angularly rotatable about said guide member.

10. The movable load support of claim 9 including at least one hydraulic cylinder swivelably connected to said lower portion of said carriage at one end and swivelably connected at the opposite end to said body of said support arm, whereby actuation of said at least one hydraulic cylinder rotates said auxiliary roof support assembly about said upper shaft.

11. The movable load support of claim 1, further including remote controls for operating said movable load support from a location away from said mobile load support.

12. A movable load support comprising:

an elongated base frame;

drive means communicating with said base frame for moving said base frame;

a primary roof support assembly including a central roof support braced against said base frame by a plurality of extendable props said plurality of props being swivelably connected to said central roof support;

at least one auxiliary roof support assembly including an auxiliary roof support frame and an auxiliary roof support adjacent said base frame and disposed laterally from said central roof support, braced against said auxiliary roof support frame by at least one extendable prop swivelably connected to said auxiliary roof support, a carriage mounted for longitudinal movement on said base frame and coupled to said auxiliary roof support assembly by at least one extendable support assembly whereby said auxiliary roof support frame is longitudinally moveable with respect to said base frame and is laterally extendable and retractable between a position adjacent said base frame and a position distal from said base frame.

13. The movable load support of claim 12 further including a lemniscate mechanism connected between said base frame and said central roof support that operates in conjunction with said plurality of extendable props.

14. The movable load support of claim 12 further including a second lemniscate mechanism connected between said auxiliary roof support frame and said auxiliary roof support that operates in conjunction with said at least one extendable prop.

15. The movable load support of claim 12, wherein said plurality of extendable props are disposed slightly outwardly from a perpendicular orientation with respect to said base frame.

16. The movable load support of claim 12, wherein said carriage is connected to said base frame and adapted for longitudinal movement along a guide member disposed along the edge of said base frame.

17. The movable load support of claim 16, wherein said auxiliary roof support frame is connected to said carriage by a support arm, said support arm having a body pivotally connected at one end to said auxiliary support frame about a vertical axis and pivotally connected at the opposite end to said carriage about a vertical axis.

18. The movable load support of claim 17, further including a hydraulic cylinder connected between said carriage and said body of said support arm for laterally moving said auxiliary roof support frame between a first position adjacent said base frame and a second position distal therefrom and positions intermediate said first and second positions.

19. The movable load support of claim 12, wherein said auxiliary roof support frame is angularly rotatable with respect to said base frame.

20. The movable load support of claim 17 wherein said carriage includes an upper portion and a lower portion, said upper portion angularly rotatable about said guide member.

21. The movable load support of claim 20 including at least one hydraulic cylinder swivelably connected to said lower portion of said carriage at one end and swivelably connected at the opposite end to said body of said support arm, whereby actuation of said at least one hydraulic cylinder rotates said auxiliary roof support assembly about said upper shaft.

22. The movable load support of claim 12, further including remote controls for operating said movable load support from a location away from said mobile load support.

23. The movable load support of claim 12 wherein said guide member is laterally movable by a cylinder extending perpendicularly to said guide member.

24. A movable load support for supporting the roof and shielding the caving area in underground excavations, and particularly for waste edge support in pillar extraction in coal mines, said support comprising:

an elongated base frame;

drive means communicating with said base frame for transporting said base frame in a desired direction;

a primary roof support assembly including a central roof support braced against said base frame by a plurality of hydraulically actuated props and a lemniscate linkage, said plurality of extendable props swivelably connected to said central roof support;

at least one auxiliary roof support assembly disposed laterally from said central roof support and slidably connected to said base frame by a carriage adapted to move longitudinally along the edge of said base frame on upper and lower horizontally extending shafts carried on the edge of said base frame, said carriage having a first and second portion, said first portion adapted to rotate about said upper shaft, said auxiliary roof support assembly including an auxiliary roof support frame and an auxiliary roof support braced against said auxiliary roof support frame by a pair of hydraulically actuated extendable props and a second lemniscate mechanism, said pair of hydraulically actuated extendable props swivelably connected to said auxiliary roof support;

a support arm connecting said auxiliary roof support frame to said carriage, said support arm including a body pivotally connected at one end to said auxiliary roof support frame about a vertical axis and pivotally connected at an opposite end to said first portion of said carriage about a vertical axis;

an extension cylinder connected at one end to said body and at the opposite end to said first portion of said carriage for laterally reciprocating said auxiliary roof support frame between a first position adjacent said base frame and a second position distal from said base frame and positions intermediate thereof;

at least one rotation cylinder swivelably connected at one end to said arm and swivelably connected at an opposite end to said second portion of said carriage for providing angular rotation of said auxiliary roof support assembly about said upper shaft.

25. The movable load support of claim 24, further including remote controls for operating said movable load support from a location away from said mobile load support.

26. The movable load support of claim 24, further including steering hydraulic cylinders for laterally moving said upper and lower shafts.

27. The movable load support of claim 24, wherein said plurality hydraulically actuated props includes four props positioned in the corners of said base frame and which are disposed slightly outwardly from a perpendicular orientation with respect to said base frame.

28. The movable load support of claim 24, wherein said plurality of extendable props are swivelably connected to said base frame.

29. The movable load support of claim 24, wherein said auxiliary roof support assembly includes a lemniscate linkage connected between said auxiliary roof support and said auxiliary roof support frame that works in conjunction with said pair of hydraulically actuated extendable props.

30. The movable load support of claim 24, wherein said carriage is longitudinally moved along said upper and lower shafts by a horizontally disposed hydraulic cylinder mounted on said base frame.

31. A method of supporting a roof and shielding a caving area in underground excavations comprising the steps of:

providing at least one movable roof support having a central roof support carried on a base frame and at least one auxiliary roof support assembly longitudinally movable on said base frame, said auxiliary roof support assembly including an auxiliary roof support laterally displaced from said central roof support and laterally reciprocable between a first position adjacent said base frame and a second position distal from said base frame and positions intermediate thereof;

transporting said movable roof support to a desired area;

raising said central roof support into engagement with the stratification;

laterally extending said at least one auxiliary roof support to a desired location;

raising said at least one auxiliary roof support into engagement with the stratification;

after the desired excavation cycle has occurred, lowering said central roof support and transporting said movable roof support a predetermined distance while maintaining said at least one auxiliary roof support in engagement with said stratification;

raising said central roof support into engagement with the stratification;

lowering said at least one auxiliary roof support and advancing said at least one auxiliary roof support longitudinally a predetermined distance along said base frame while maintaining said central roof support in engagement with said stratification; and raising said at least one auxiliary roof support into engagement with the stratification.

32. The method of claim 31, further including the step of transporting each of said at least one movable roof support to a desired location.

33. The method of claim 31 wherein said at least one movable roof support includes three movable roof supports.

34. A movable load support comprising:

an elongated base frame;

drive means communicating with said base frame for moving said base frame;

a primary roof support assembly including a central roof support braced against said base frame by a first extendable prop and a first lemniscate mechanism;

at least one auxiliary roof support assembly longitudinally movably connected to said base frame by a carriage, said auxiliary roof support assembly including an auxiliary roof support frame and an auxiliary roof support disposed adjacent said base frame and laterally from said central roof support and at least one extendable cylinder connected between said carriage and said auxiliary roof support assembly, and said auxiliary roof support braced against said auxiliary roof support frame by at least one extendable prop swivelably connected to said auxiliary roof support.

35. The movable load support of claim 34 further including a second lemniscate mechanism carried on said auxiliary roof support frame that operates in conjunction with said at least one extendable prop.

36. The movable load support of claim 34, wherein said first extendable prop is disposed in a substantially vertical orientation.

37. The movable load support of claim 34, wherein said carriage is adapted for longitudinal movement along an upper and lower shaft disposed along the edge of said base frame.

38. The movable load support of claim 37, wherein said auxiliary roof support frame is connected to said carriage by a support arm, said support arm having a body pivotally connected at one end to said auxiliary support frame about a vertical axis and pivotally connected at the opposite end to said carriage about a vertical axis.

39. The movable load support of claim 38, further including a hydraulic cylinder connected between said carriage and said body of said support arm for laterally moving said auxiliary roof support frame between a first position adjacent said base frame and a second position distal therefrom and positions intermediate said first and second positions.

40. The movable load support of claim 34, wherein said auxiliary roof support frame is angularly rotatable with respect to said base frame.

41. The movable load support of claim 38 wherein said carriage includes an upper portion and a lower portion, said upper portion angularly rotatable about said upper shaft.

42. The movable load support of claim 41 including at least one hydraulic cylinder swivelably connected to said lower portion of said carriage at one end and swivelably connected at the opposite end to said body of said support arm, whereby actuation of said at least one hydraulic cylinder rotates said auxiliary roof support assembly about said upper shaft.

43. A movable load support of claim 34, further including remote controls for operating said movable load support from a location away from said mobile load support.

44. The movable load support of claim 34, wherein said guide member is laterally movable by a cylinder extending perpendicularly to said guide member.

* * * * *